US010955184B2

(12) United States Patent
Kim et al.

(10) Patent No.: US 10,955,184 B2
(45) Date of Patent: Mar. 23, 2021

(54) REFRIGERATOR

(71) Applicant: LG ELECTRONICS INC., Seoul (KR)

(72) Inventors: Dongseok Kim, Seoul (KR); Younseok Lee, Seoul (KR); Junsoo Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 143 days.

(21) Appl. No.: 15/891,631

(22) Filed: Feb. 8, 2018

(65) Prior Publication Data

US 2018/0259239 A1 Sep. 13, 2018

(30) Foreign Application Priority Data

Mar. 10, 2017 (KR) ..... 10-2017-0030599

(51) Int. Cl.
*F25D 17/06* (2006.01)
*F25D 21/14* (2006.01)
(Continued)

(52) U.S. Cl.
CPC ..... *F25D 17/065* (2013.01); *F25B 39/028* (2013.01); *F25D 17/045* (2013.01);
(Continued)

(58) Field of Classification Search
CPC .... F25D 21/14; F25D 17/0065; F25D 17/045; F25D 21/06; F25D 23/069; F25D 2317/063; F25D 17/065
See application file for complete search history.

(56) References Cited

U.S. PATENT DOCUMENTS 2,994,209 A 8/1961 Mann et al.
3,103,109 A 9/1963 Krug et al.
(Continued)

FOREIGN PATENT DOCUMENTS

DE 199 56 998 6/2000
DE 10 2014 218411 3/2016
(Continued)

OTHER PUBLICATIONS

Chinese Office Action dated Dec. 17, 2019 issued in Application No. 201810188025.7.
(Continued)

*Primary Examiner* — Edward F Landrum
*Assistant Examiner* — Alexis K Cox
(74) *Attorney, Agent, or Firm* — KED & Associates LLP

(57) ABSTRACT

A refrigerator includes an evaporator installed inside an evaporator case, a water tray provided below the evaporator and configured to collect water, a grill cover provided at a rear side of the evaporator case and configured to accommodate a blower fan, and a tray support provided in the grill cover to support the water tray. The grill cover may include a first grill cover having a fan suction portion configured to guide cold air passing through an evaporator to a blower fan. At least one supply port may protrude from a front surface of the first grill cover through which the cold air is supplied to a storage chamber. A water tray may be supported on an upper side of the at least one supply port.

16 Claims, 26 Drawing Sheets

(51) Int. Cl.

| | |
|---|---|
| ***F25B 39/02*** | (2006.01) |
| ***F25D 17/04*** | (2006.01) |
| ***F25D 21/06*** | (2006.01) |
| ***F25D 23/06*** | (2006.01) |

(52) U.S. Cl.
CPC ..... *F25D 21/06* (2013.01); *F25D 21/14* (2013.01); *F25D 23/069* (2013.01); *F25D 2317/063* (2013.01); *F25D 2317/067* (2013.01); *F25D 2317/0666* (2013.01); *F25D 2700/12* (2013.01)

(56) References Cited

U.S. PATENT DOCUMENTS

| | | | | |
|---|---|---|---|---|
| 3,135,102 | A * | 6/1964 | Ullstrand | F25D 17/062 62/414 |
| 3,209,553 | A * | 10/1965 | Sohda | F25D 21/125 62/283 |
| 3,310,957 | A * | 3/1967 | Saunders | F25D 17/065 62/273 |
| 3,774,408 | A * | 11/1973 | Pruehs | F25D 21/14 62/285 |
| 6,293,122 | B1 | 9/2001 | Chang | |
| 2002/0139135 | A1* | 10/2002 | Noritake | F16K 11/052 62/408 |
| 2009/0056364 | A1* | 3/2009 | Gorz | F25D 17/065 62/407 |
| 2011/0011106 | A1 | 1/2011 | Ahn et al. | |
| 2011/0011118 | A1* | 1/2011 | Cho | F25D 17/065 62/419 |
| 2012/0000231 | A1* | 1/2012 | LaFontaine | F25D 21/14 62/291 |
| 2014/0157812 | A1* | 6/2014 | Hwang | F25D 17/062 62/285 |
| 2018/0087822 | A1* | 3/2018 | Han | F25D 17/065 |
| 2018/0087823 | A1* | 3/2018 | Han | F25D 21/14 |
| 2018/0087824 | A1* | 3/2018 | Han | F25D 21/004 |

FOREIGN PATENT DOCUMENTS

| | | |
|---|---|---|
| EP | 2 694 894 | 3/2016 |
| KR | 10-2010-0043845 | 4/2010 |
| KR | 10-2011-0006997 | 1/2011 |
| KR | 10-2012-0008756 | 2/2012 |
| KR | 10-1386469 | 4/2014 |
| WO | WO 2011/007959 | 1/2011 |
| WO | WO 2012/136532 | 10/2012 |
| WO | WO 2013/098110 | 7/2013 |

OTHER PUBLICATIONS

European Search Report dated Jun. 25, 2018 issued in Application No. 18158575.3.

* cited by examiner

REFRIGERATOR

CROSS-REFERENCE TO RELATED APPLICATION

This application claims priority under 35 U.S.C. § 119 to Korean Application No. 10-2017-0030599 filed on Mar. 10, 2017, whose entire disclosure is incorporated herein by reference.

BACKGROUND

1. Field

A refrigerator is disclosed herein.

2. Background

A refrigerator may include a plurality of storage chambers in which food or items (hereinafter "food") may be stored in a frozen state or a refrigerated state. The plurality of storage chambers may be opened such that the food may be accommodated and withdrawn. The plurality of storage chambers may include a freezer compartment configured to store food in a frozen state and a refrigerator compartment configured to store food in a refrigerated state.

A refrigeration system in which a refrigerant circulates may be provided in the refrigerator. Devices constituting the refrigeration system may include a compressor, a condenser, an expansion device, and an evaporator. Refrigerant may be evaporated while passing through the evaporator, and air passing through or near a vicinity of the evaporator may be cooled. The cooled cold air may be supplied to the freezer compartment or the refrigerator compartment. The evaporator may be installed on or at a rear side of the storage chambers and may extend vertically along the rear side.

There has been a lot of effort to reduce sizes of components of the refrigeration system required in the refrigerator while increasing volumes or sizes of the storage chambers. However, as described above, when the evaporator is provided on or at the rear side of the storage chambers, the sizes of the storage chambers may be reduced to provide a space for installation of the evaporator.

The refrigerator may include drawers that may be withdrawn out from the storage chambers. Front-rear widths of the storage chambers may be reduced due to arrangement of the evaporator, and front-to-rear lengths of the drawers may be reduced. Accordingly, the withdrawal distances of the drawers or how far out the drawers may be pulled out may be reduced. If the withdrawal distances of the drawers are reduced, it may be inconvenient for a user to accommodate food in the drawers.

Installing the evaporator in a partition wall by which the refrigerator compartment and the freezer compartment are partitioned has been developed. In a side-by-side refrigerator in which a freezer compartment and a refrigerator compartment may be arranged on two sides, for example, left and right sides, of the refrigerator, because a partition wall extends vertically between the freezer compartment and the refrigerator compartment, water generated by the evaporator may be easily discharged.

However, in a refrigerator in which a refrigerator compartment and a freezer compartment are arranged on, for example, upper and lower sides of the refrigerator, because a partition wall extends transversely between the freezer compartment and the refrigerator compartment, it may be difficult to discharge water generated by an evaporator.

EP Patent No. 2,694,894 (Mar. 23, 2016), which is incorporated herein by reference, discloses installing an evaporator in a partition wall by which a refrigerator compartment and a freezer compartment are separated from each other, in a refrigerator in which the refrigerator compartment is located at an upper portion of the refrigerator and the freezer compartment is located at a lower portion of the refrigerator. However, the evaporator is arranged to be inclined downward as it extends rearward. Such an arrangement of the evaporator may be for easily discharging water generated by the evaporator to a lower side. However, because the evaporator is arranged to be inclined as it extends rearwards, a thickness of the partition wall for an insulator and the evaporator may be increased. When the thickness of the partition wall is increased, storage chambers of the refrigerator may become relatively smaller.

A lower surface of the partition wall is downward inclined due to the inclined arrangement of the evaporator, and correspondingly, a side surface of a drawer provided at an upper portion of the freezer compartment may be downward inclined as it extends rearward. In this case, storage ability for food decreases. According to such an arrangement of the evaporator, because a fan may be located right behind the evaporator, the water generated by the evaporator may flow into the fan, and thus, malfunction of the fan may occur.

When cold air having high humidity passes through the fan, a condensate may be generated in the fan. According to EP Patent No. 2,694,894, a separate water passage for discharging the condensate of the fan is not provided, and the condensate flows to a duct to which the cold air is supplied. In this case, frost caused by the condensate may be generated in the duct.

A tray to collect water may need to be provided at a lower side of the evaporator. According to the arrangement of the evaporator according EP Patent No. 2,694,894, to decrease the thickness of the partition wall as much as possible, the tray should be provided at the lower side of the evaporator to be very close to the evaporator. Because the water stored in the tray may be frosted or cold, heat exchange performance of the evaporator may deteriorate.

BRIEF DESCRIPTION OF THE DRAWINGS

The embodiments will be described in detail with reference to the following drawings in which like reference numerals refer to like elements, and wherein.

DETAILED DESCRIPTION

Figure 1:
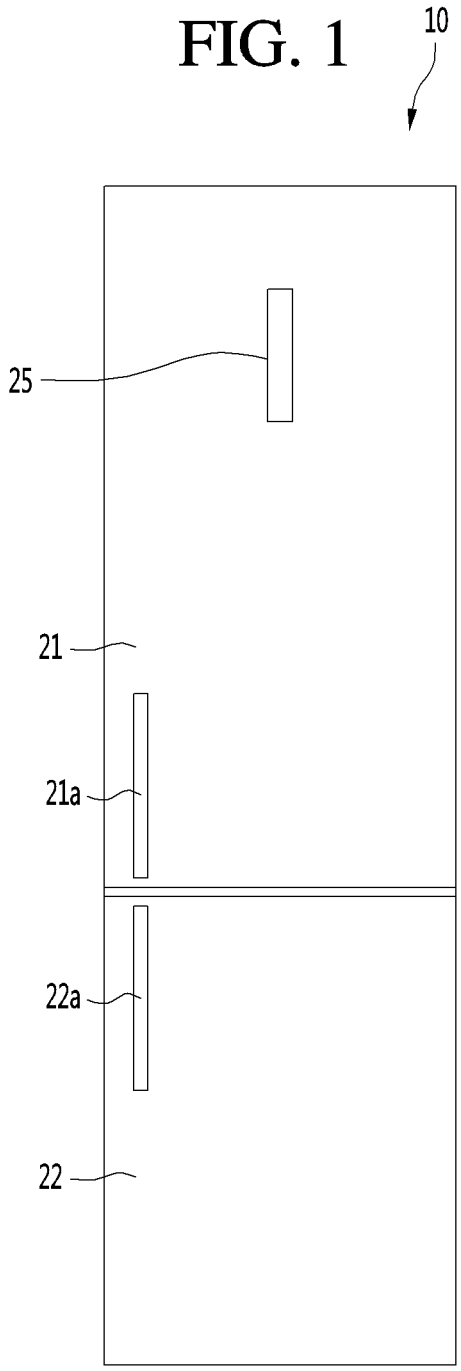
FIG. 1 is a front view of a refrigerator according to an embodiment.
Figure 2:
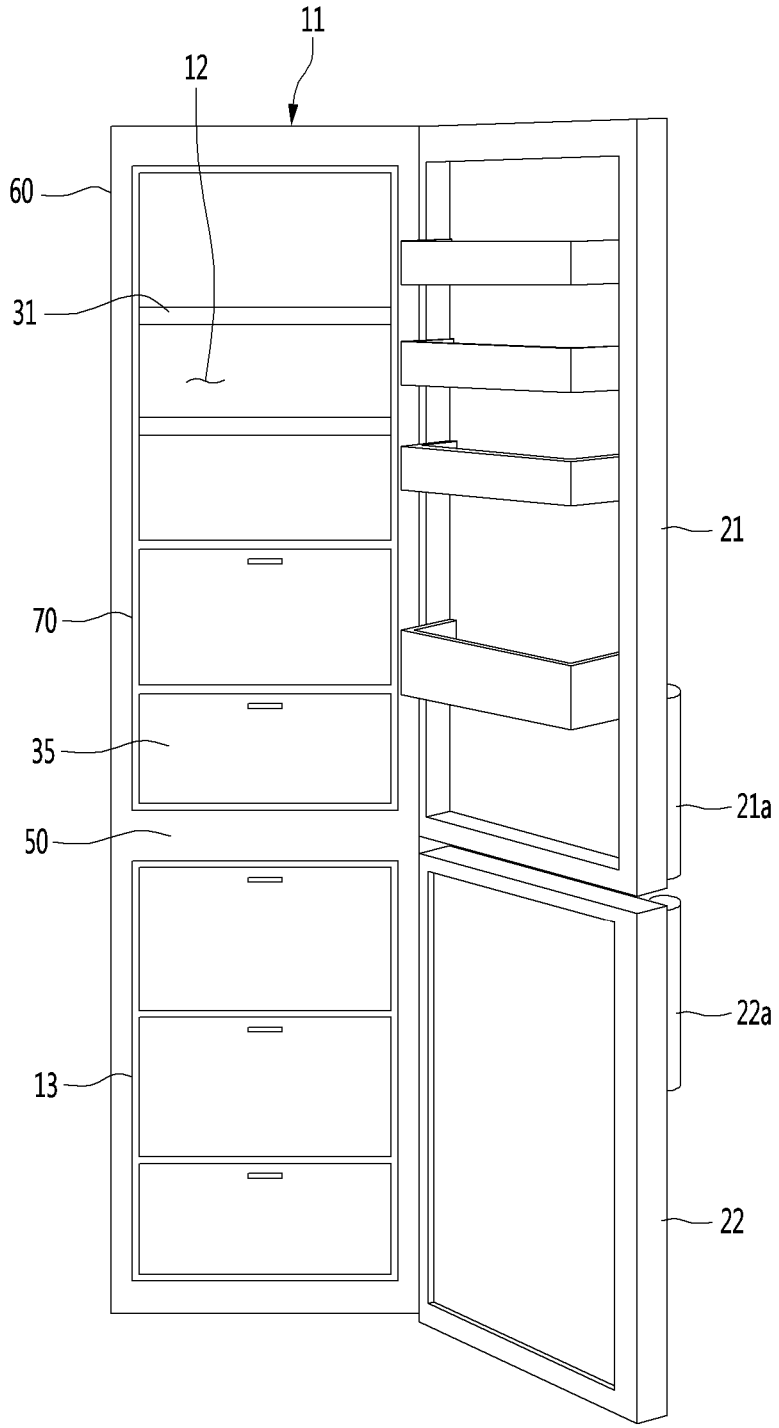
FIG. 2 is a front view of the refrigerator of FIG. 1 with opened doors.
Figure 3:
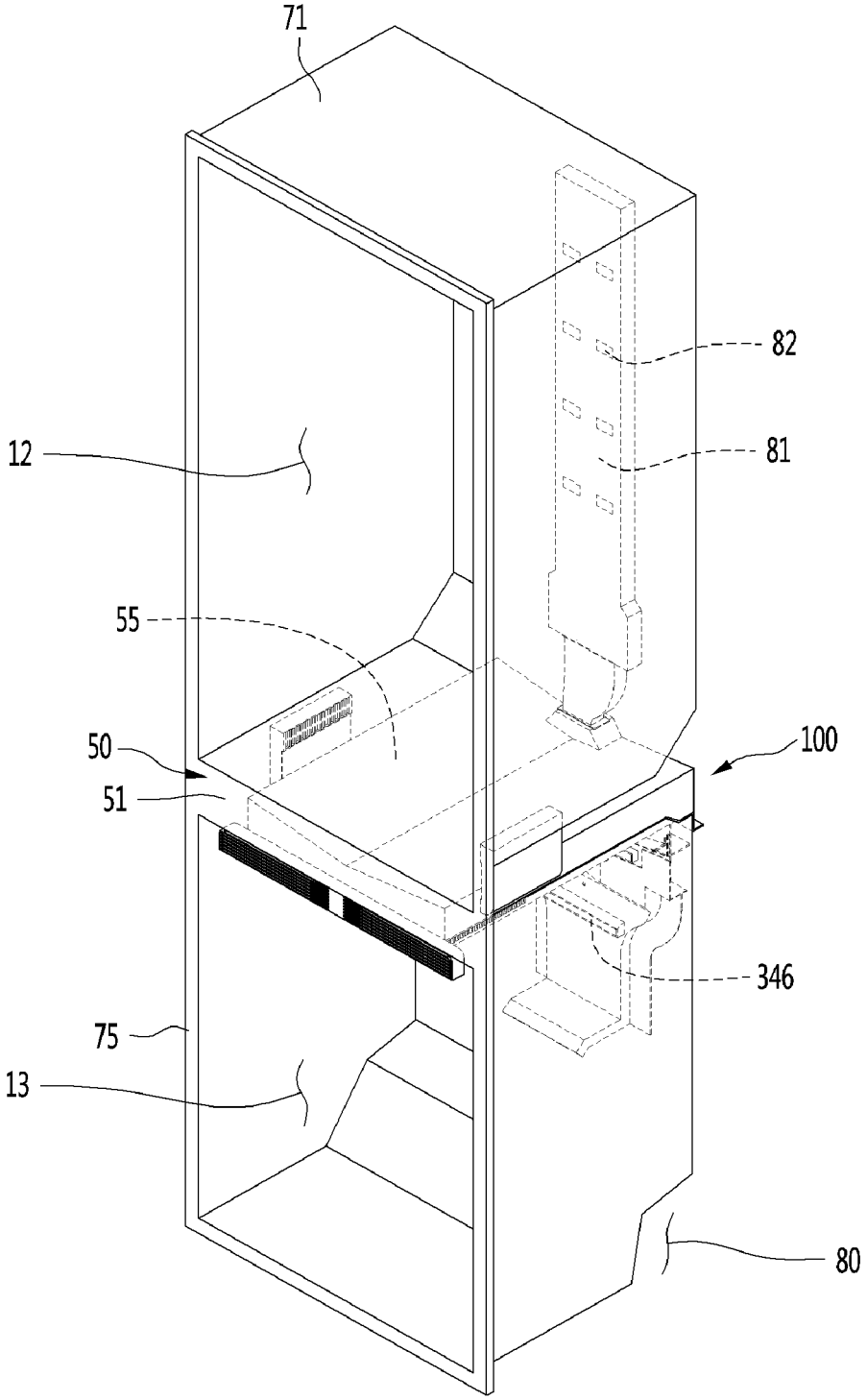
FIG. 3 is a view of an inner case and a cold air supplier provided in the refrigerator of FIG. 1.

Referring to FIG. 1 to FIG. 3, a refrigerator 10 may include a cabinet 11 in which a storage chamber may be provided, and doors 21 and 22 may be provided on a front or first surface of the cabinet 11 to selectively open/close the storage chamber. The cabinet 11 may have a rectangular shape having an open front or first surface. The cabinet 11 may include an outer case 60 defining an outer appearance of the refrigerator and an inner case 70 coupled to an inside of the outer case 60 and defining an inner surface of the storage chamber. A cabinet insulator 65 (see FIG. 23) that provides insulation between an outside of the refrigerator and the storage chamber may be provided between the outer case 60 and the inner case 70.

The storage chamber may include a first storage chamber 12 and a second storage chamber 13 controlled at different temperatures. The first storage chamber 12 may be a refrigerator compartment 12, and the second storage chamber 13 may be a freezer compartment 13, but embodiments are not limited thereto. For example, the refrigerator compartment 12 may be formed at an upper or first portion of the cabinet 11, and the freezer compartment 13 may be formed at a lower or second portion of the cabinet 11. The refrigerator compartment 12 may be arranged above the freezer compartment 13. According to such a configuration, because the refrigerator compartment 12 may be more frequently used to store or withdraw food and may be arranged at a height corresponding to a waist of a user, the user may not need to bend his/her waist when the refrigerator compartment 12 is used, so that user convenience may be improved.

The refrigerator 10 may include a partition wall 50 by which the refrigerator compartment 12 and the freezer compartment 13 may be partitioned. The partition wall 50 may be provided in the cabinet 11 to extend from a front or first side toward a rear or second side of the cabinet 11. For example, the partition wall 50 may extend from the front or first side toward the rear or second side of the cabinet 11 in a direction perpendicular to the ground.

The doors 21 and 22 may include a refrigerator compartment door 21 rotatably provided on a front or first side of the refrigerator compartment 12 and a freezer compartment door 22 rotatably provided on a front or first side of the freezer compartment 13. As another example, the freezer compartment door 22 may be a drawer door provided to be forwardly withdrawable, but embodiments are not limited thereto.

A first handle 21*a*, which the user may grip, may be provided on a front or first surface of the refrigerator compartment door 21, and a second handle 22*a* may be provided on a front or first surface of the freezer compartment door 22. The refrigerator 10 may include a plurality of shelves 31 provided in the storage chambers to accommodate food. As an example, the plurality of shelves 31 may be provided in the refrigerator compartment 12 to be vertically spaced apart from each other.

The refrigerator 10 may include drawers 35 provided to be withdrawable from the storage chamber. The drawers 35 may be provided in the refrigerator compartment 12 and the freezer compartment 13, and may have accommodation spaces for food formed therein. Front-to-rear lengths of the drawers 35 may be increased as front-to-rear widths of the storage chambers become larger, and accordingly, withdrawal distances of the drawers 35 may be increased. When the withdrawal distances of the drawers 35 are increased, space for the user to accommodate food may be improved. Thus, it may be important in terms of user convenience that the refrigerator may be configured such that the front-to-rear widths of the storage chambers may become relatively larger.

A direction in which the drawers 35 may be withdrawn may be defined as a forward or first direction, and a direction in which the drawers 35 may be accommodated may be defined as a rearward or second direction. A leftward direction when the refrigerator 10 is viewed from the front side of the refrigerator 10 may be defined as a leftward or third direction, and a rightward direction when the refrigerator 10 is viewed from the front side of the refrigerator 10 may be defined as a rightward or fourth direction. These directions may be applied throughout the specification.

The refrigerator 10 may further include a display 25 configured to display information on temperatures and operating states of the storage chambers of the refrigerator 10. For example, the display 25 may be provided on the front or first surface of the refrigerator compartment door 21.

The inner case 70 may include an inner refrigerator compartment case or first inner case 71 defining the refrigerator compartment 12. The inner refrigerating compartment case 71 may have an open front or first surface and may have an approximately rectangular or box shape. The inner case 70 may further include an inner freezer compartment case or second inner case 75 defining the freezer compartment 12. The inner freezer compartment case 75 may have an open front or first surface and may have an approximately rectangular or box shape. The inner freezer compartment case 75 may be arranged below the inner refrigerator compartment case 71 to be spaced apart from the inner refrigerator compartment case 71.

The partition wall 50 may be arranged between the inner refrigerator compartment case 71 and the inner freezer compartment case 75. The partition wall 50 may include a partition wall front 51 defining a front outer appearance of the partition wall 50. When the doors 21 and 22 are opened, the partition wall front 51 may be located between the refrigerator compartment 12 and the freezer compartment 13 when viewed from an outside.

Because temperatures of the refrigerator compartment 12 and the freezer compartment 13 may be different from each other, the partition wall 50 may further include a partition wall insulator 55 provided on a rear or second side of the partition wall front 51 to insulate the refrigerator compartment 12 and the freezer compartment 13 from each other. The partition wall insulator 55 may be arranged between a bottom surface of the inner refrigerator compartment case 71 and an upper surface of the inner freezer compartment case 75. The partition wall 50 may include or may be defined by the bottom surface of the inner refrigerator compartment case 71, the partition wall insulator 55, and the upper surface of the inner freezer compartment case 75.

The refrigerator 10 may include a cold air supplier 100 configured to supply cold air to the refrigerator compartment 12 and the freezer compartment 13. The cold air supplier 100 may be arranged below the partition wall insulator 55. For example, the cold air supplier 100 may be installed on an inner upper surface of the inner freezer compartment case 75.

The cold air generated by the cold air supplier 100 may be supplied to the refrigerator compartment 12 and the freezer compartment 13, respectively. A refrigerator compartment cold air duct 81, through which at least a portion of the cold air generated by the cold air supplier 100 may flow, may be provided on the rear or second side of the refrigerator compartment 12. Refrigerator compartment cold air supplying parts or vents 82 configured to supply the cold air to the refrigerator compartment 12 may be formed in the refrigerator compartment cold air duct 81. The refrigerator compartment cold air duct 81 may define a rear or second wall of the refrigerator compartment 12, and the refrigerator compartment cold air supplying vents 82 may be formed on a front or first surface of the refrigerator compartment cold air duct 81.

The cold air supplier 100 may include a freezer compartment cold air supplying part or port configured to supply at least a portion of the cold air generated by the cold air supplier 100 to the freezer compartment 13. The freezer compartment cold air supplying port may include a second supply part or port 346.

A machine room 80 may be formed on or at a lower rear side of the inner freezer compartment case 75. A compressor and an evaporator as components constituting a refrigeration cycle may be installed in the machine room 80.

Figure 4:
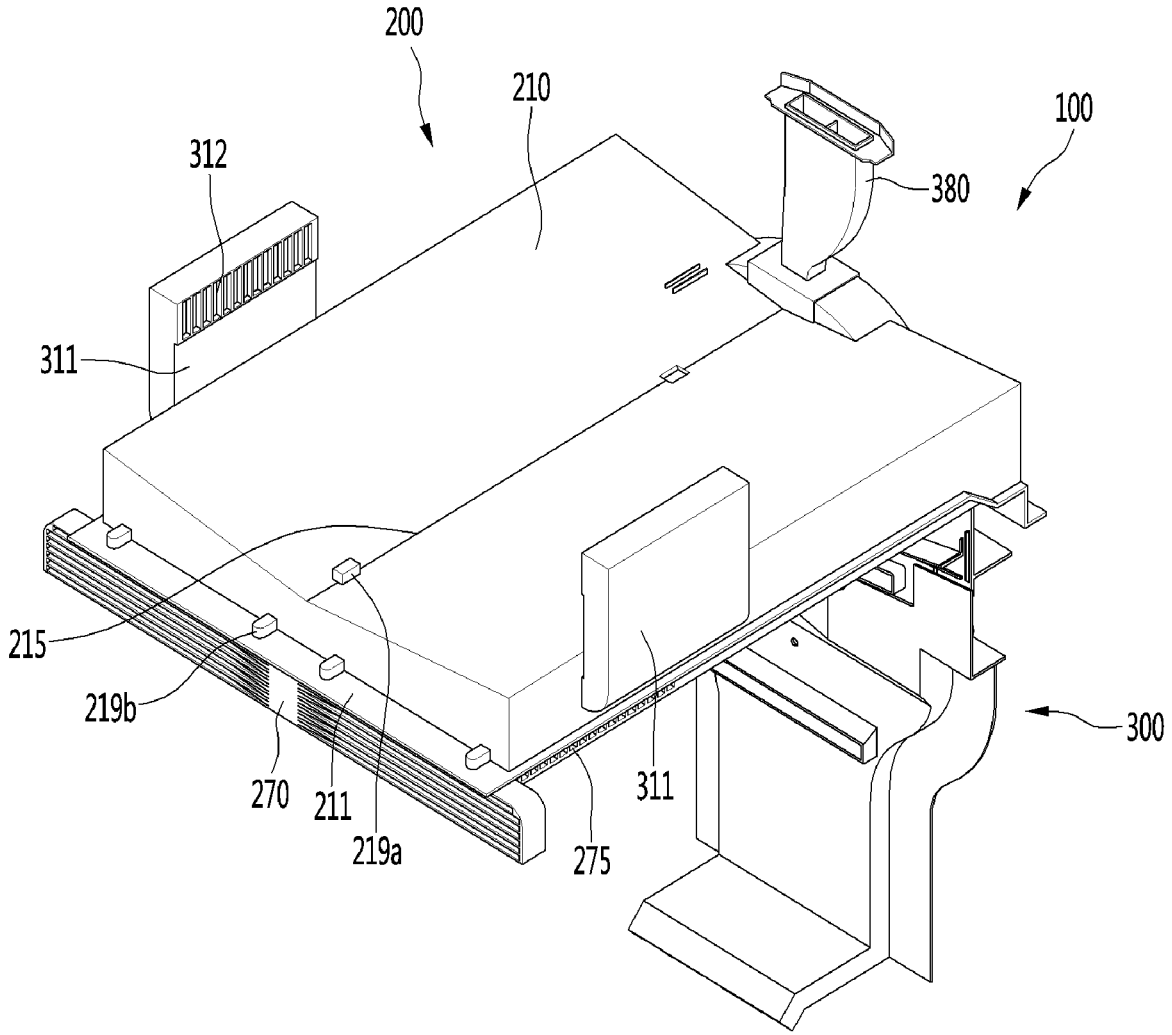
FIG. 4 is a view of the cold air supplier of FIG. 3.
Figure 5:
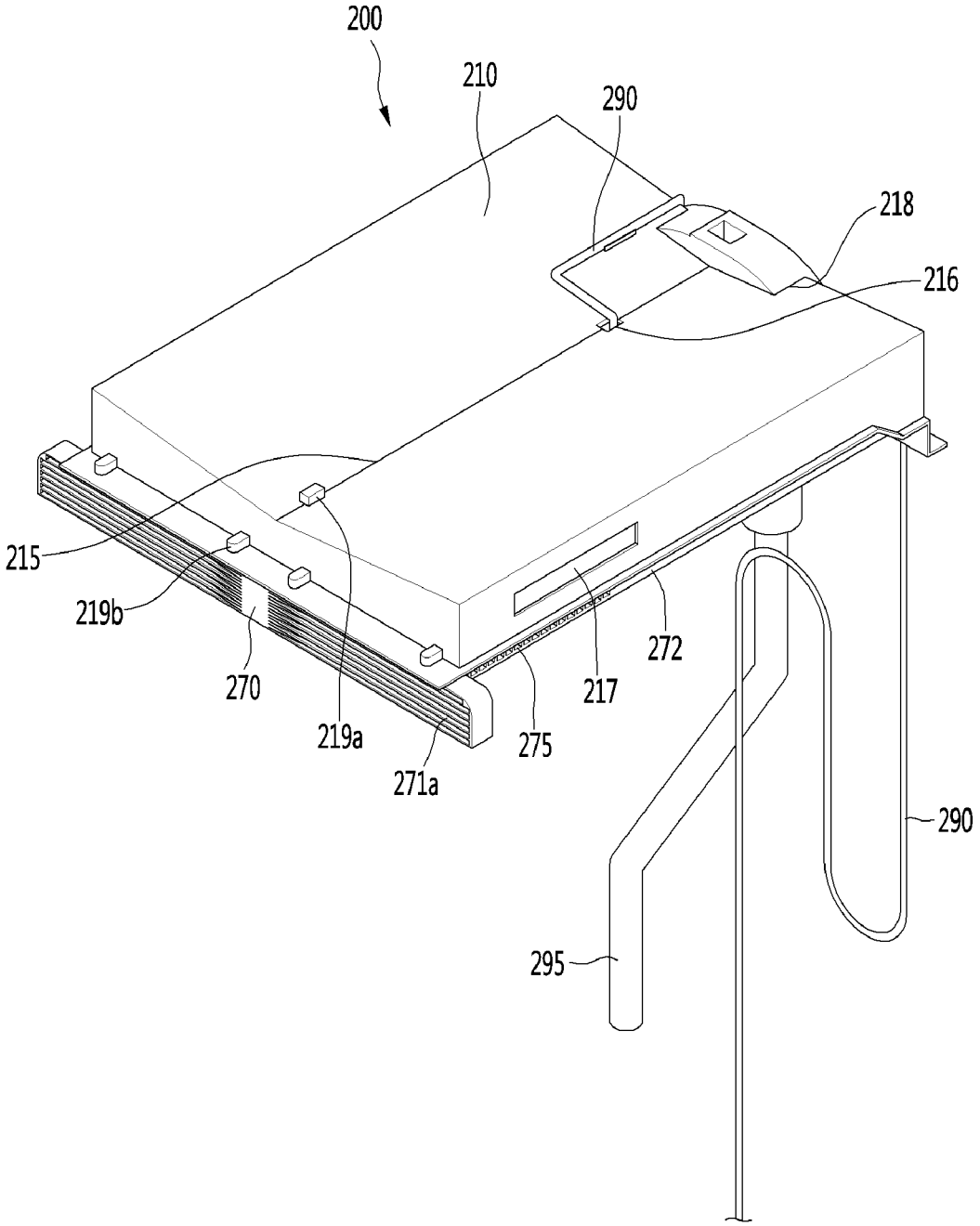
FIG. 5 is a view of a cold air generator of the cold air supplier.
Figure 6:
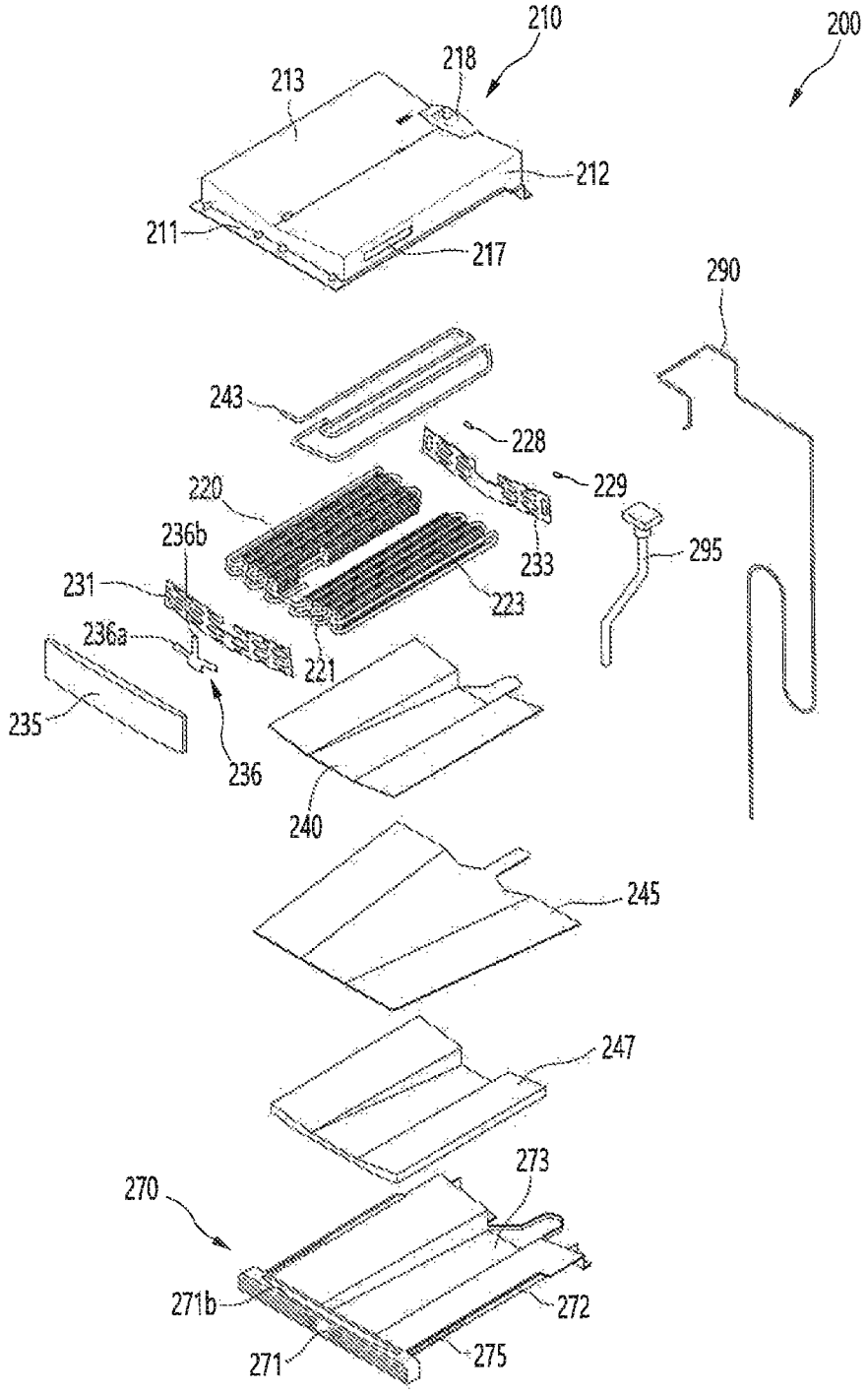
FIG. 6 is an exploded perspective view of the cold air generator of FIG. 5.
Figure 7:
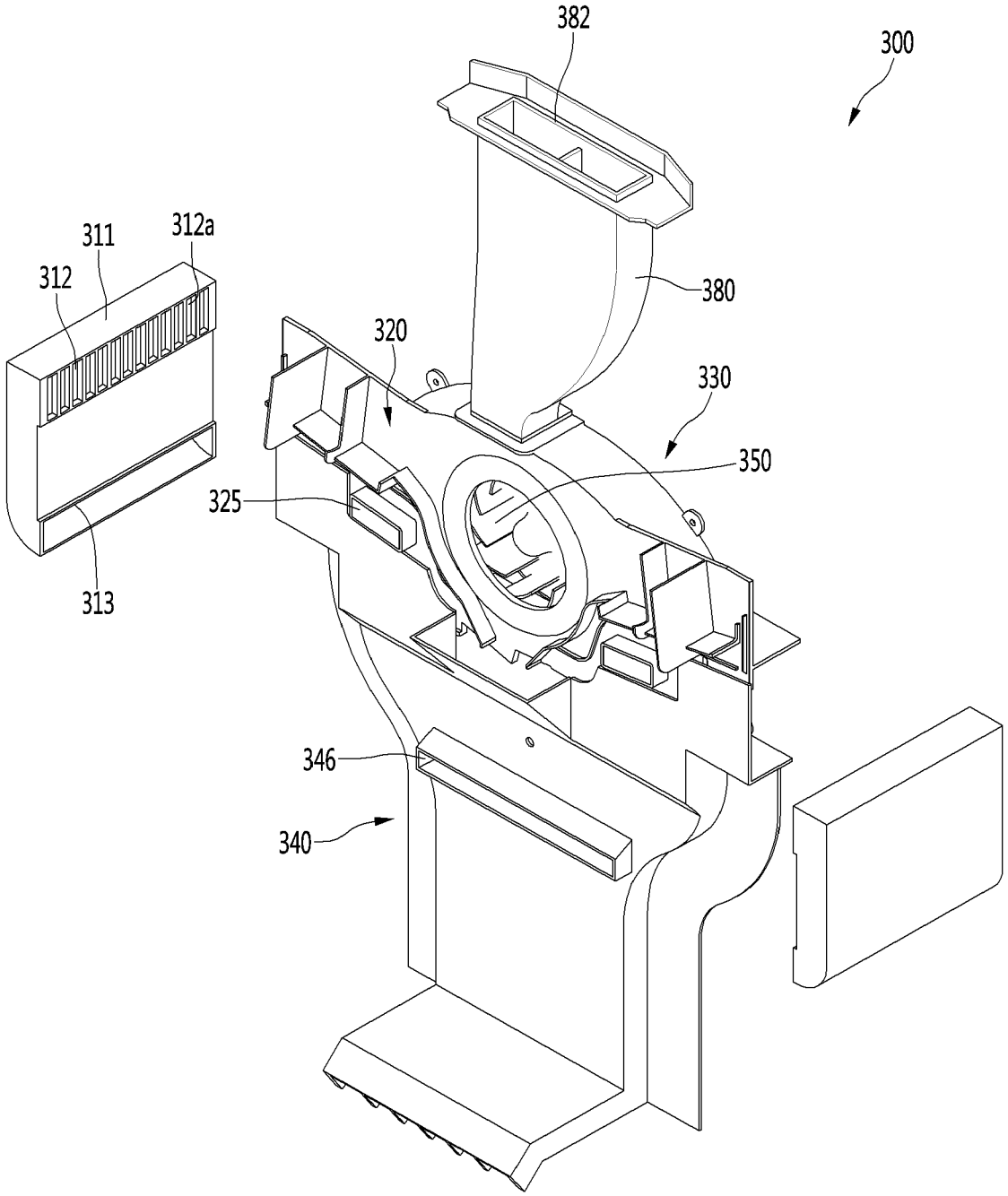
FIG. 7 is a view of a flow supply of the cold air supplier of FIG. 5.
Figure 8:
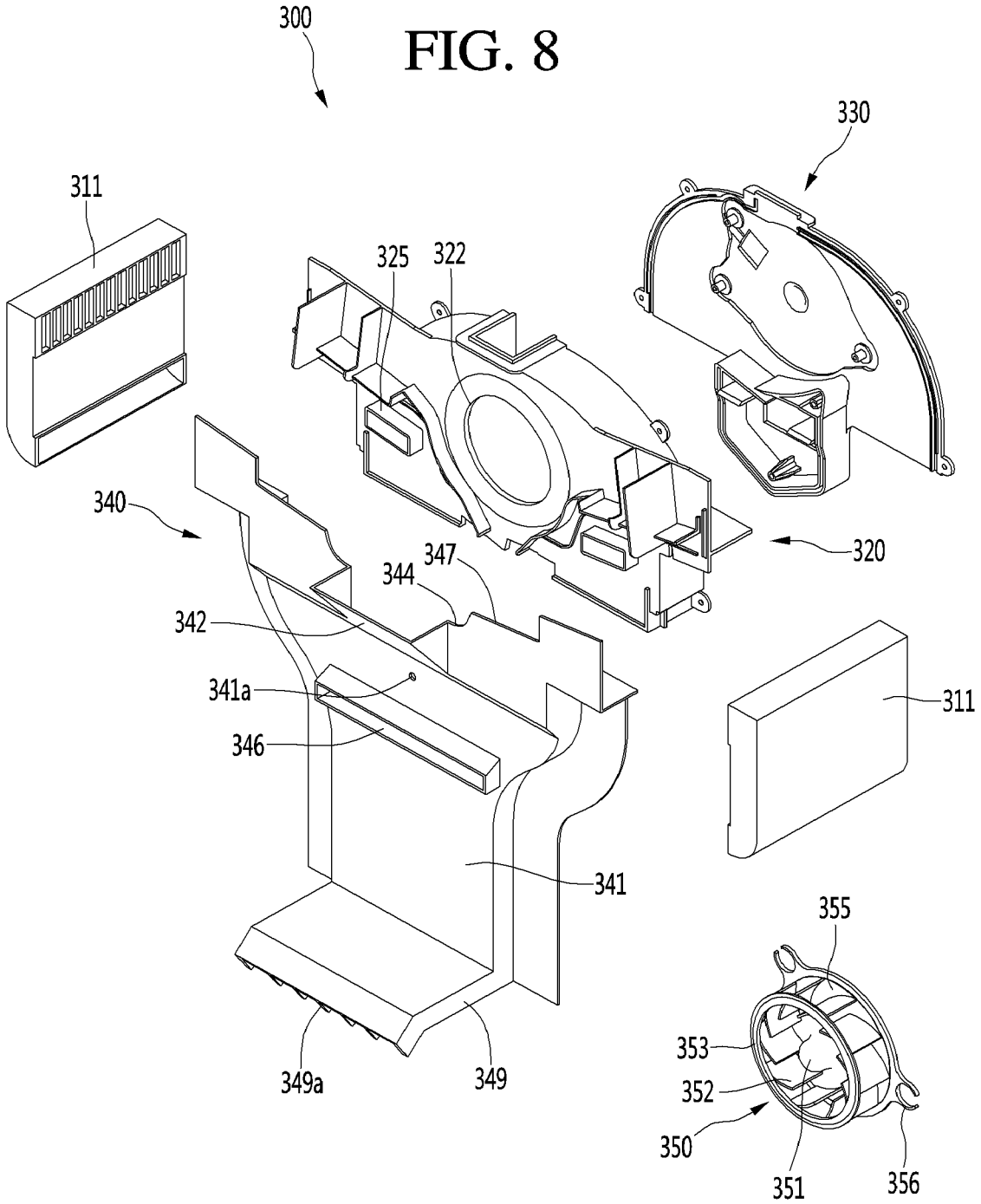
FIG. 8 is an exploded perspective view of the flow supply of FIG. 7.

Referring to FIG. 4 to FIG. 6, the cold air supplier 100 may include a cold air generator 200 configured to generate cold air using evaporation heat of a refrigerant circulating in the refrigeration cycle and a flow supply part or flow supplier 300 configured to supply cold air generated by the cold air generator 200 to the storage chambers.

The cold air generator 200 may include an evaporator 220 in which the refrigerant may be evaporated, a first cover 210 provided above the evaporator 220, and a second cover 270 provided below the evaporator 220. The first cover 210 may be coupled to an upper portion of the second cover 270, and an inner space defined by the first and second covers 210 and 270 may define an installation space in which the evaporator 220 may be installed. Further, the first and second covers 210 and 270 may together be referred to as an "evaporator case" accommodating the evaporator 220, and the installation space may be referred to as an "evaporation chamber" or a "heat exchange chamber". The evaporator cases 210 and 270 may be located on or at a bottom surface of the partition wall 50. The partition wall 50 may be provided to insulate the refrigerator compartment 12 from the installation space or heat exchange chamber.

The evaporator 220 may include refrigerant pipes 221 through which the refrigerant may flow and fins 223 coupled to the refrigerant pipes 221 to increase a heat exchange area for the refrigerant. The first cover 210 may form at least a portion of the inner freezer compartment case 75. For example, the first cover 210 may form an inner upper surface of the inner freezer compartment case 75. The first cover 22 may be formed integrally with the inner freezer compartment case 75. The first cover 210 may include a first front cover part or cover 211 provided in front of the evaporator 220, first side cover parts or covers 212 extending rearward from opposite sides of the first front cover part 211, and a first upper cover part or cover 213 coupled to upper sides of the opposite first side covers 212.

A recessed part or groove 215 may be formed at a center of the first upper cover part 213. The recessed groove 215 may extend from a front or first side to a rear or second side of the first upper cover 213. The first upper cover 213 may extend to be upward inclined from the recessed groove 215 to opposite left and right or lateral sides or third and fourth sides. Such a shape may correspond to a shape of the evaporator 220, which may extend to be inclined in a left-right direction.

Each of the first side covers 212 may include a first duct coupling part or first duct recess 217 to which a discharge duct 311 of the flow supply part 300 may be coupled. For example, the first duct recesses 217 may be formed in or at opposite first side covers 212, respectively. The first duct recesses 217 may be arranged on opposite surfaces (for example, a left or first surface and a right or second surface) of the first cover 210.

The cold air stored in the refrigerator compartment 12 may be discharged through the discharge ducts 311, and the discharged cold air may flow to the inner space defined by the first cover 210 and the second cover 270 via the first duct recesses 217. The cold air may be further cooled while passing through the evaporator 220.

The first cover 210 may include a grill cover coupling part or coupler 218 to which first and second grill covers 320 and 330 of the flow supply part 300 may be coupled. For example, the grill cover coupler 218 may be vertically provided, and upper portions of the first and second grill covers 320 and 330 may be inserted into the grill cover coupler 218. At least a portion of the cold air generated by the evaporator 220 may flow to a first supply duct 380 and may be supplied to the refrigerator compartment 12. The grill cover coupler 218 may be formed in the first upper cover 213.

A pipe penetration part or pipe hole 216 through which a suction pipe 290 may pass may be formed in the first cover 210. The suction pipe 290 may be a pipe configured to guide the refrigerant evaporated by the evaporator 220 to the compressor. The suction pipe 290 may extend from the gas-liquid separator 260, may pass through the pipe hole 216, and may extend to the compressor arranged in the machine room 80. The pipe hole 216 may be formed in the recessed groove 215.

The second cover 270, which may support the evaporator 220, may be arranged in the freezer compartment 13. For example, the second cover 270 may be arranged on or at a lower side of the inner freezer compartment case 75. The second cover 270 may include a cover seating part or cover seat 273 arranged on or at a lower side of the evaporator 220 to support the evaporator 220 or a water tray 240. The cover seating part 273 may be shaped to be downwardly inclined, that is, to be recessed, from opposite left and right or lateral sides toward a center, to correspond to an inclined shape of the evaporator 220 and an inclined shape of the water tray 240.

The second cover 270 may further include a second front cover part or cover 271 provided in front of the cover seat 273. Through-holes 271*a* (see FIG. 5) through which the cold air stored in the freezer compartment 13 may pass may be formed in or at the second front cover 271. For example, the through-holes 271*a* may be formed on opposite sides or ends of the second front cover 271 to guide the cold air located on a front side of the freezer compartment 13 such that the cold air may easily flow to cover discharge holes 275. By formation of the through-holes 271*a*, flow resistance of the cold air flowing toward the cover discharge holes 275 may be reduced.

The second cover 270 may further include second side cover parts or covers 272 coupled to opposite sides of the second front cover part 271 to extend rearward. The second side covers 272 may be coupled to opposite sides of the cover seat 273 to extend upward. The first cover 210 may be coupled to upper portions of the second side covers 272.

The cover discharge holes 275 configured to guide the cold air stored in the freezer compartment 13 to the evaporator 220 may be formed in the second side covers 272. For example, a plurality of holes may be included in the cover discharge holes 275, and the plurality of holes may be arranged from a front or first side toward a rear or second side of the second side covers 272. The cold air in the freezer compartment 13 may flow to the inner space defined by the first and second covers 210 and 270 through the cover discharge holes 275 and may be cooled while passing through the evaporator 220.

The cold air generator 200 may further include a first heater 243 coupled to the evaporator 220 to supply a predetermined amount of heat to the evaporator 220. The first heater 243, which may be a heater configured to provide an amount of heat to melt ice or frost in the evaporator 220, may also be referred to as a "first defrosting heater". For example, the first heater 243 may be coupled to an upper portion of the evaporator 220.

Figure 9:
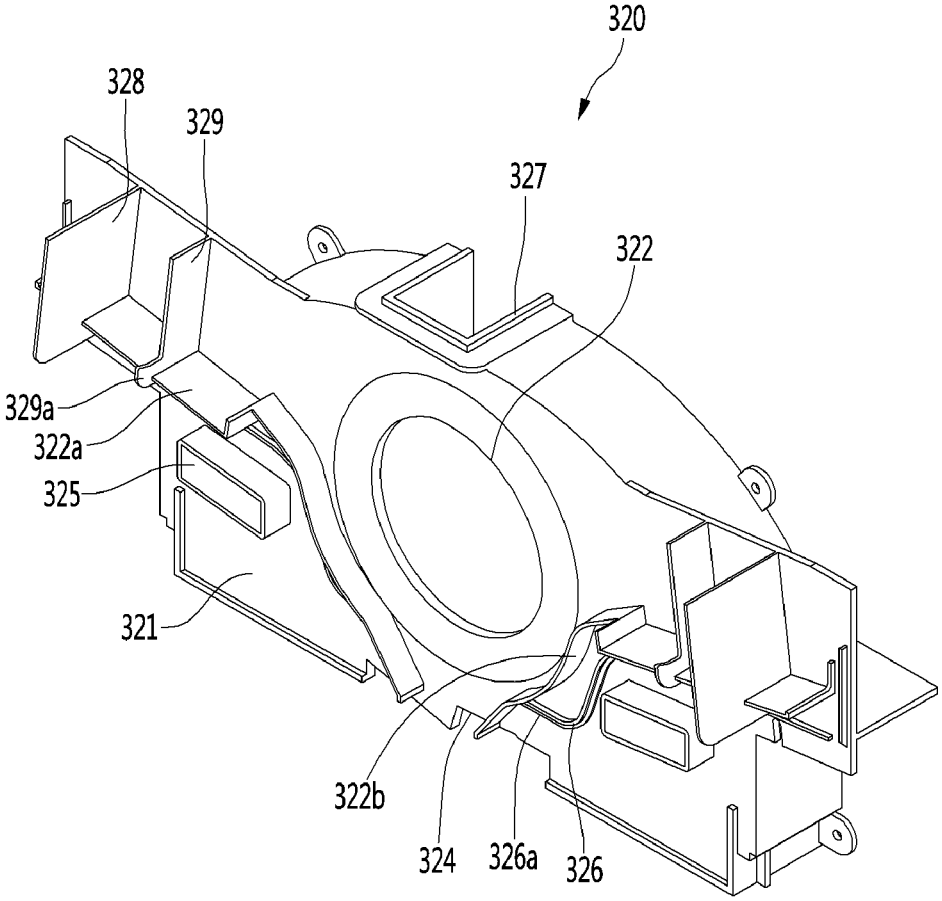
FIG. 9 is a perspective view of a first grill cover according to an embodiment.
Figure 10:
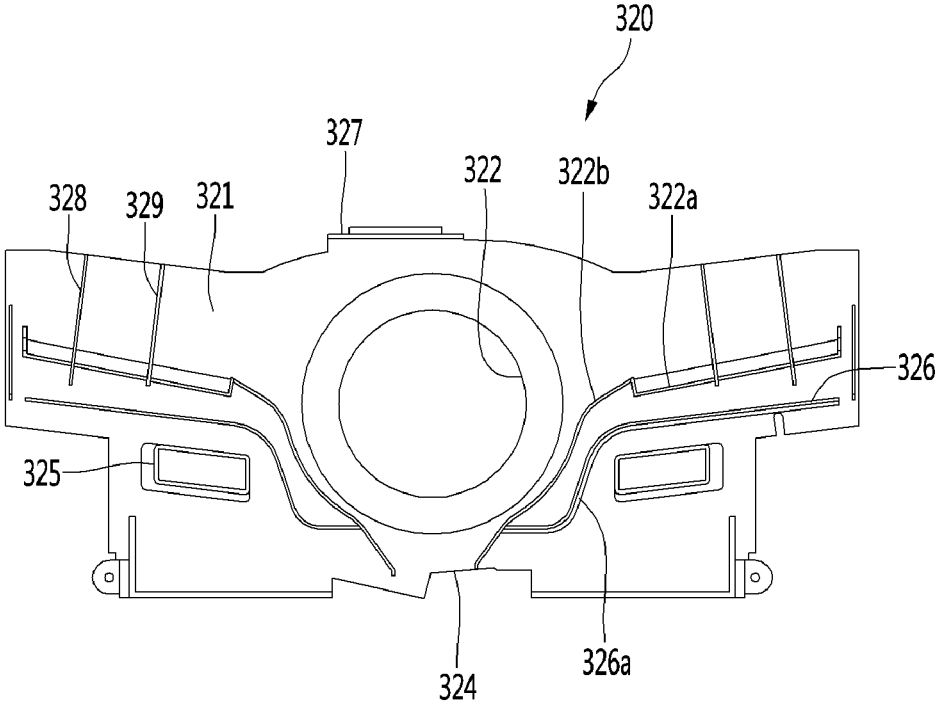
FIG. 10 is a front view of the first grill cover of FIG. 9.
Figure 11:
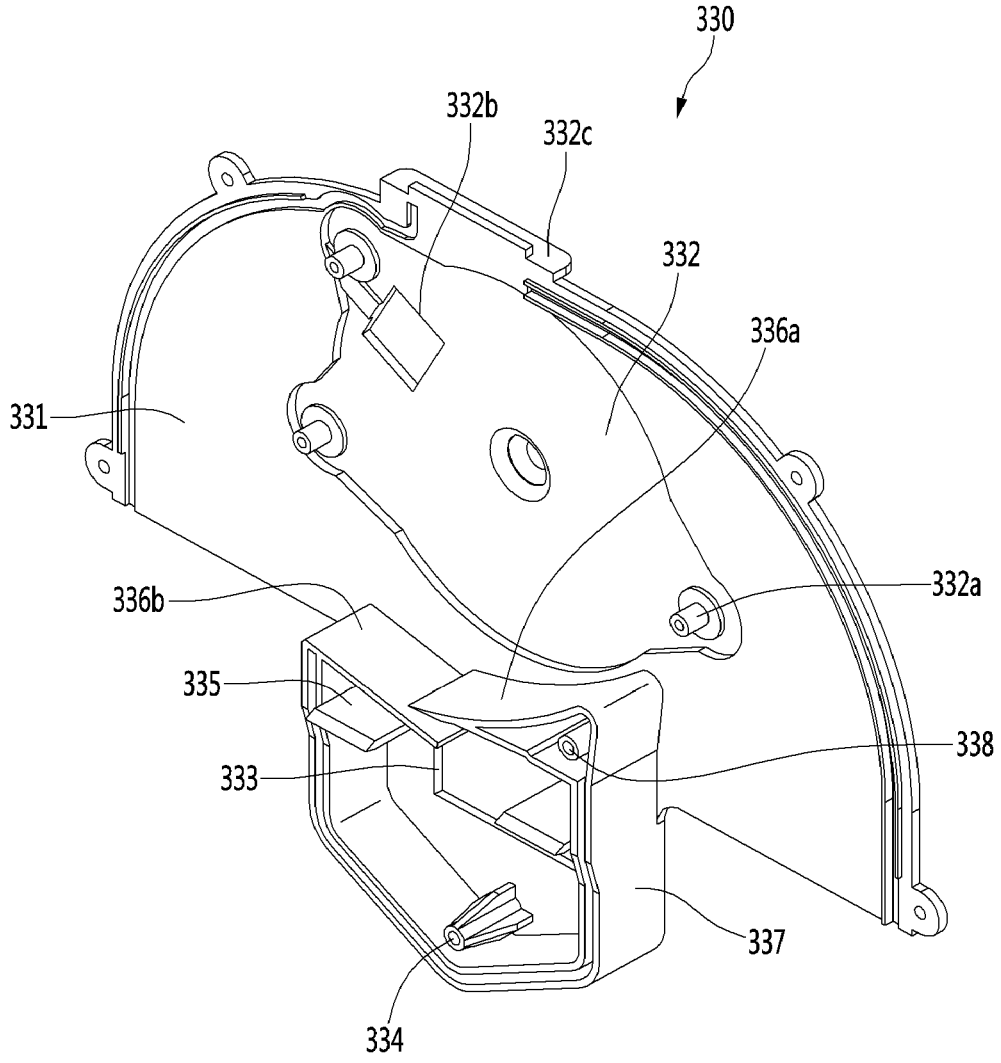
FIG. 11 is a perspective view of a second grill cover according to an embodiment.
Figure 12:
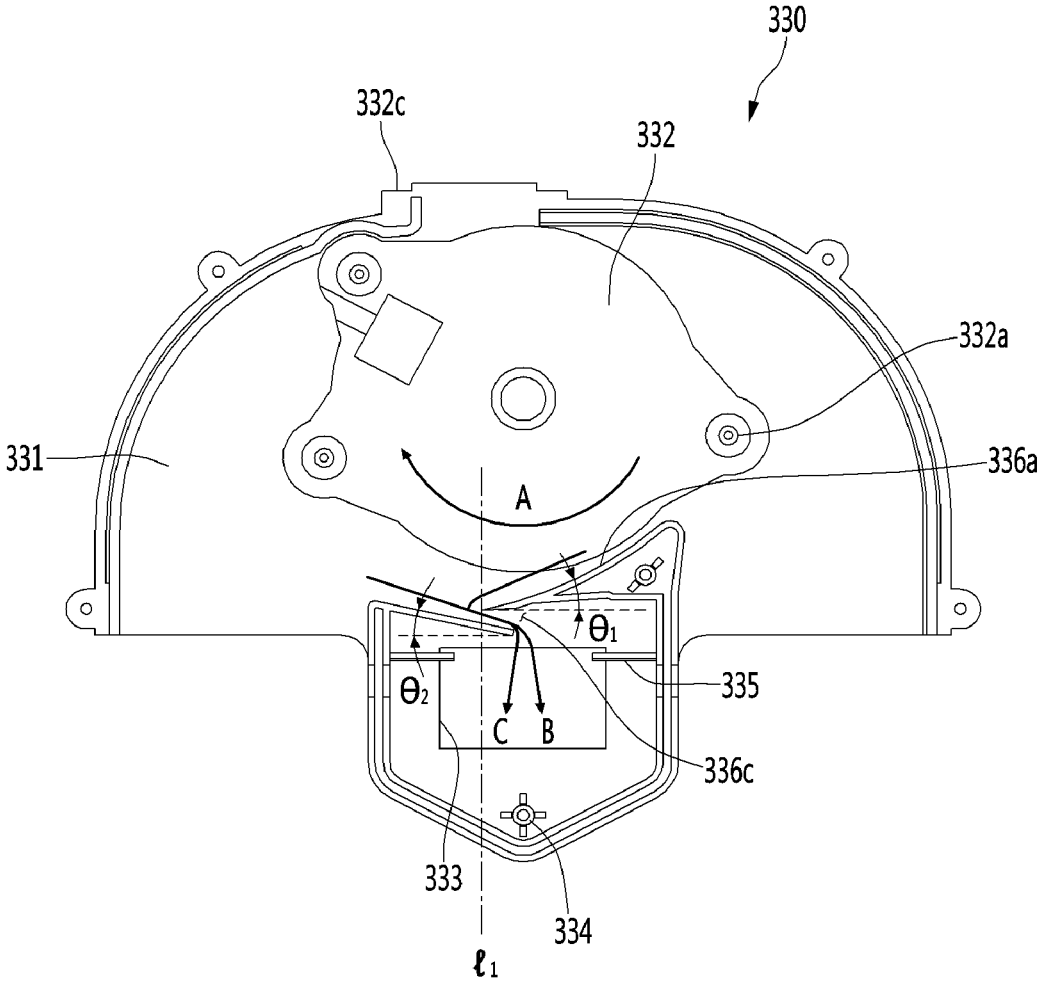
FIG. 12 is a front view of the second grill cover of FIG. 11.

The cold air generator 200 may further include evaporator supporting devices or supports 231, 233, 236, and 329 configured to support the evaporator 220. The evaporator supports 231, 233, 236, and 329 may be located inside the evaporator cases 210 and 270. The evaporator supports 231, 233, 236, and 329 may include evaporator holders 231 and 233, a hook device or hook 236, and support guides 329 (see FIG. 9).

The evaporator holders 231 and 233 may include a first holder 231 that supports a front or first portion of the evaporator 220 and a second holder 233 that supports a rear or second portion of the evaporator 220. The first holder 231 may be located on or at a front upper side of the water tray 240 and the second holder 233 may be located on or at a rear upper side of the water tray 240.

The hook 236 may be provided in the first holder 231 to support the evaporator 220. For example, the hook 236 may be arranged on or at a front surface of the first holder 231 to support the refrigerant pipes 221 of the evaporator 220. The hook 236 may include a plurality of second pipe supports 236*a* that support bent pipes of the refrigerant pipes 221, which may protrude to a front side of the first holder 231, and a cover coupling part or coupler 236*b* that may protrude upward from the plurality of second pipe support 236*a* and may be coupled to the first cover 210. The plurality of second pipe supports 236*a* may be provided on opposite sides of the hook 236 to support bent pipes of the refrigerant pipes 221.

The first cover 210 may include a hook coupling part or coupler 219*a* to which the cover coupler 236*a* may be coupled. The hook coupler 219*a* may be provided in the upper cover 213. The cover coupler 236*a* may protrude upward from the upper cover 213 to be caught or held by the hook coupler 219*a*. For example, the hook coupler 219*a* may be provided in the recessed groove 215.

The support guides 329 may be provided in the first grill cover 320. For example, the support guides 329 may protrude forward from a front or first surface of the first grill cover 320 to support the refrigerant pipes 221 of the evaporator 220. The support guides 329 may include a first pipe support 329*a* that support bent pipes of the refrigerant pipes 221, which may protrude to a rear or second side of the second holder 233. The first pipe support 329*a* may be provided below the support guides 329, may have a downward recessed shape, and may stably support the bent pipes. The plurality of support guides 329 may be provided on opposite sides of the first grill cover 320. Thus, a plurality of heat exchangers 220 may be stably supported by the plurality of support guides 329.

The first and second covers 210 and 270 may be coupled to each other. A cover fixing part or fastener 219*b* to which a screw may be fastened may be provided in the first front cover 211 of the first cover 210. The screw may be coupled to the cover fixing fastener 219*b*, may extend downward, and may be fastened to an upper portion of the second front cover 271 of the second cover 270. For example, the cover fixing fastener 219*b* may be provided in plurality, and a plurality of cover fixing fasteners 219*b* may be transversely spaced apart from each other. According to such a structure, the front portions of the first and second covers 210 and 270 may be stably coupled.

The cold air generator 200 may further include a sensor 228 configured to detect a temperature near the evaporator 220 to determine a defrosting start time or a defrosting termination time of the evaporator 220. The sensor 228 may be installed in the evaporator holders 231 and 233, for example, the second holder 233.

The cold air generator 200 may further include a fuse 229 configured to interrupt a current applied to the first heater 243. When the temperature of the evaporator 220 is more than a predetermined temperature, the fuse 229 may be cut to interrupt the current supplied to the first heater 243, so that an accident may be prevented. The fuse 229 may be installed in the evaporator holders 231 and 233, for example, the second holder 233.

The cold air generator 220 may further include evaporator insulators configured to perform insulation between a heat exchange area formed near the evaporator 220 and a space outside the heat exchange area. The evaporator insulators may include a cover insulator 235 arranged on a front or first side of the first holder 231 to insulate a front space of the evaporator 220. The cover insulator 235 may be inserted into an insulator inserting part or insulator space 271*b* formed in or at the second front cover 271 of the second cover 270.

The evaporator insulators may include a tray insulator 247 supported by the second cover 270. The tray insulator 247 may be arranged below the water tray 240 to insulate a lower space of the evaporator 220. The tray insulator 247 may be seated on the cover seat 273 of the second cover 270 and may be positioned below a second heater 245. The tray insulator 247 may prevent heat generated by the second heater 245 from being applied to or released into the freezer compartment 13.

The cold air generator 220 may further include the water tray 240 arranged below the evaporator 220 to collect defrosted water generated by the evaporator 220. The water tray 240 may be shaped to be recessed from opposite sides toward a central portion of the water tray 240 to correspond to a shape of the evaporator 220. Thus, the defrosted water generated by the evaporator 220 may be stored or accommodated in the water tray 240 and may be flow to the central portion of the water tray 240.

A distance between the evaporator 220 and the central portion of the water tray 240 may be larger than a distance between the evaporator 220 and opposite sides of the water tray 240. In other words, the distance of a space between the water tray 240 and the evaporator 220 may gradually increase from opposite sides toward central portions of the evaporator 220 and the water tray 240. According to such a configuration, even when an amount of the water flowing to the central portion of the water tray 240 increases, it may not contact a surface of the evaporator 220, so that frost in the evaporator 220 may be prevented.

The cold air generator 200 may further include the second heater 245 arranged below the water tray 240 to supply a predetermined amount of heat to the water tray 240. The second heater 245, which may be a heater configured to provide an amount of heat for melting ice or frost in the water tray 240. The second heater 245 may be arranged between the water tray 240 and the tray insulator 247.

For example, the second heater 245 may include a surface-shaped heater having a shape of a plate or a panel. The second heater 245 may be provided on a bottom surface of the water tray 240, and thus, the water flowing along an upper surface of the water tray 240 may not be disturbed by the second heater 245, so that the water may be easily discharged. Further, the water may not be applied to or contact a surface of the second heater 245, so that a phenomenon in which the second heater 245 may be corroded or malfunctioned by the water may be prevented.

The cold air generator 200 may further include a drain pipe 295 configured to discharge the water collected in the water tray 240 from the water tray 240. The drain pipe 295 may be arranged on a rear or second side of grill covers 320, 330, and 340. Further, the drain pipe 295 may be connected to a rear or second side of the water tray 240, may extend downward, and may communicate with the machine room 80. The water may flow through the drain pipe 295 to be introduced into the machine room 80, and may be collected in a drain pan provided in the machine room 80.

Referring to FIG. 7 to FIG. 12, the flow supply 300 may include fan assemblies 350 and 355 configured to generate flow of the cold air. The fan assemblies 350 and 355 may include a blower fan 350. The blower fan 350 may include a centrifugal fan by which cold air may be introduced in an axial direction and may be discharged in a circumferential direction. The cold air flowing through a refrigerator compartment suction passage and the cold air flowing through a freezer compartment suction passage may be combined with each other and the combined cold air may be introduced into the blower fan 350.

The blower fan 350 may include a hub 351 to which a fan motor may be coupled, a plurality of blades 352 arranged on an outer peripheral surface of the hub 351, and a bell mouth 353 coupled to front ends of the plurality of blades 352 to guide the cold air such that the cold air is introduced into the blower fan 350. The blower fan 350 may be installed in or at an inner space between the first and second grill covers 320 and 330. The blower fan 350 may be seated on a fan seating part or seat 332 (see FIG. 11) provided in the grill covers 320 and 330. The fan seating part 332 may be provided in the second grill cover 330.

The fan assemblies 350 and 355 may include a fan support 355 coupled to the blower fan 350 to allow the blower fan 350 to be supported on the grill covers 320 and 330. The fan support 355 may include a plurality of fan cover supports 356 coupled to fan support coupling parts or couplers 332*a* of the fan seat 332. The plurality of fan cover supports 356 may be formed along a circumference of the fan support 355.

The first and second grill covers 320 and 330 may define a fan installation space in which the fan assemblies 350 and 355 may be installed. The grill covers 320 and 330 may be located on or at a rear or second side of the freezer compartment 13, that is, on or at a front side of a rear surface of the inner freezer compartment case 75. The grill covers 320 and 330 may include a first grill cover 320 and a second grill cover 330 coupled to a rear or second side of the first grill cover 320. The fan installation space may be defined as an inner space formed by coupling the first and second grill covers 320 and 330 to each other.

The first grill cover 320 may include a first grill cover body 321 having a plate shape and a fan suction part or portion 322 formed in the first grill cover body 321 to guide the cold air heat-exchanged by the evaporator 220 such that the cold air may flow to the blower fan 350. The fan suction portion 322 may be formed at an approximately central portion of the first grill cover body 321 and may have a circular shape. The air passing through the evaporator 220 may be introduced into the fan installation space via the fan suction part 322.

Condensate guides 322*a* and 322*b* configured to guide condensate generated around the fan suction portion 322 or condensate generated in the evaporator 220 to a lower side of the fan suction portion 322 may be provided outside the fan suction portion 322. The condensate generated around the fan suction portion 322 may include condensate generated in the first and second grill covers 320 and 330 or the blower fan 350.

The condensate guides 322*a* and 322*b* may protrude from a front or first surface of the first grill cover body 321. The condensate guides 322*a* and 322*b* may include first guides 322*a* downwardly inclined from opposite sides of the front surface of the first grill cover body 321 to a central portion of the first grill cover body 321. Thus, the condensate or water existing on the front or first side of the first grill cover body 321 may be discharged to the central portion of the first grill cover body 321 along the first guides 322*a*.

The first guides 322*a* may be downwardly inclined from the front or first surface of the first grill cover body 321 toward the front or first side. Thus, the condensate or water existing on the front or first side of the first grill cover body 321 may flow along the first guides 322*a* and may drop to the water tray 240.

The condensate guides 322*a* and 322*b* may further include second guides 322*b* downwardly inclined from opposite sides of the fan suction portion 322. The second guides 322*b* may be connected to the first guides 322*a* to extend toward a central portion of the first grill cover body 321. The second guides 322*b* may extend to be rounded.

The first grill cover 320 may further include blocking parts or shields 328. The blocking shields 328 may be provided on a front or first surface of the first grill cover body 321 and may act to block the cold air to prevent the cold air from being directly introduced from opposite rear sides of the evaporator 220 to the fan suction portion 322.

At least a portion of the cold air introduced into the evaporator cases 210 and 270 through the first duct couplers 217 and the cover discharging holes 275 may flow from opposite sides to the rear or second side of the evaporator 220 without passing through the evaporator 220, and may be suctioned to the fan suction portion 322. Thus, the blocking shields 328 may be provided in order to prevent the cold air from bypassing the evaporator 220 and being directly suctioned to the fan suction portion 322.

The blocking shields 328 may be provided on opposite sides of the front or first surface of the first grill cover body 321 to protrude forward so as to prevent flow of the cold air suctioned to the fan suction portion 322 along the front or first surface of the first grill cover body 321. The blocking shields 328 may be stably supported on the upper surfaces of the first guides 322*a*.

The first grill cover 320 may further include mounting guides 326. The mounting guides 326 may guide the second cover 270 such that the second cover 270 may be stably supported on the first grill cover 320. The mounting guides 326 may be provided on the front or first surface of the first grill cover body 321 and support a rear or second side of the second cover 270.

The mounting guides 326 may protrude forward from the front or first surface of the first grill cover body 321 and may be spaced apart from upper portions of first supply parts or ports 325. A rear portion of the second cover 270 may be inserted into spaces between the mounting guides 326 and the first supply ports 325 and may be stably supported. Thus, the water tray 240 supported by the second cover 270 may be also stably supported on the first grill cover 320.

The mounting guides 326 may extend to be inclined or rounded from lower portions of the condensate guides 322*a* and 322*b*. A configuration of the mounting guides 326 may correspond to a shape of the second cover 270. The mounting guides 326 may be provided on opposite sides of the fan suction portion 322.

Sealing members or seals 326*a* being in contact with the second cover 270 may be provided on lower sides of the mounting guides 326. When the second cover 270 is mounted on the front side of the first grill cover 320, the seals 326*a* come into close contact with the rear or second side of the second cover 270. Accordingly, the second cover 270 may be stably supported, and the water may be prevented from being leaked along a space between the second cover 270 and the mounting guides 326.

A first duct coupling part or coupler 327 may be provided in the first grill cover 320. The first duct coupler 327 may be provided at an upper portion of the first grill cover body 321. The first duct coupler 327 may be a part to which the first supply duct 380 may be coupled, together with a second duct coupler 332*c* of the second grill cover 330. The duct coupler may have a shape of a coupling hole or space to communicate with the first supply duct 380.

The first grill cover 320 may include a first recessed part or recess 324 recessed upward from a lower portion of the first grill cover body 321. The first recess 324 may define a first cover inserting part or portion 324, 342, and 344 into which the second cover 270 or the water tray 240 of the cold air generator 200 may be inserted, together with a second recessed part or recess 344 and an insertion guide 342 of the third grill cover 340. The second recess 344 may be recessed downward from an upper portion of the third grill cover 340, and the insertion guide 342 may be provided on a front or first surface of the third grill cover 340 to protrude forward from the second recess 344.

When the third grill cover 340 is coupled to the front side of the first grill cover 320, the first and second recesses 324 and 344 and the insertion guide 342 may be engaged with each other to define the first cover inserting portion 324, 344, and 342. The first cover inserting part 324, 344, and 342 may be understood as an insertion hole of the first and second grill covers 320 and 340.

The second grill cover body 330 may further include a second cover inserting part or portion 333 into which the second cover 270 or the water tray 240 of the cold air generator 200 324, 344, and 342 may be inserted. The second cover 270 or the water tray 240 may extend to the first and third grill covers 320 and 340 through the first cover inserting portion 324, 344, and 342 and extend to a rear or second side of the second grill cover 330 through the second cover inserting portion 333. The second cover 270 or the water tray 240 may be connected to the drain pipe 295, and the water stored in the defrosting water tray 240 may be introduced into the drain pipe 295 (see FIG. 23).

The third grill cover 340 may be coupled to a front or first side of the first grill cover 320. The third grill cover 340 may extend to the lower side of the first grill cover 320. The third grill cover 340 may include a third grill cover body 341 having a plate shape and a fastening hole 341*a* formed in the third grill cover body 341 and coupled to a third grill cover coupler or coupler 334 of the second grill cover 330. A predetermined fastening member or fastener may pass through the fastening hole 341*a* of the third grill cover 340 to be coupled to the third grill cover coupler 334. The third grill cover coupler 334 may include a protrusion rib into or onto which the fastening member may be inserted.

The third grill cover body 341 may further include the insertion guide 342 that protrudes forward from the third grill cover body 341 and may be configured to guide the second cover 270 or the water tray 240 such that the second cover 270 or the water tray 240 may be inserted into the first and third grill cover 320 and 340. Because the insertion guide 342 protrudes forward from the second recess 344, a space through which the second cover 270 or the water tray 240 may be inserted through the first cover inserting portion 324, 344, and 342 may be sufficiently secured.

The third grill cover body 341 may further include a first grill cover support 347 that supports the first supply ports 325. The first grill cover support 347 may extend the second recess 344 toward an outside or end of the third grill cover body 341. The first supply ports 325 may protrude from the first grill cover body 321 and may be supported on an upper side or edge of the first grill cover support 347.

The grill covers 320, 330, and 340 may include a plurality of cold air supplying parts or ports 325 and 326 configured to discharge the cold air passing through the blower fan 350 to the freezer compartment 13. The plurality of cold air supplying ports 325 and 326 may include a plurality of the first supply ports 325 formed in the first grill cover 320. The plurality of first supply ports 325 may be arranged on opposite sides of the fan suction portion 322, and may be located above the first cover inserting portion 324, 342, and 344. The first supply ports 325 may supply the cold air toward an upper space of the freezer compartment 13.

For example, the first supply ports 325 may supply the cold air toward a lower surface of the cold air generator 200, that is, a bottom surface of the second cover 270. Dew may be generated on an outer surface of the second cover 270 due to a difference between an internal temperature of the second cover 270 and an internal temperature of the freezer compartment 13.

The cold air supplied through the first supply ports 325 may flow toward the second cover 270, so that the dew may be evaporated or the ice or frost existing in the second cover 270 may be removed. The first supply ports 325 may be arranged at locations lower than the bottom surface of the second cover 270. The first guides 322*a* may protrude forward and be inclined upward from the front or first surface of the first grill cover body 321.

The plurality of cold air supplying ports 325 and 346 may include a second supply part or port 346 formed in the third grill cover 340. The second supply port 346 may be formed at an approximately vertically central portion of the third grill cover 340 and may supply the cold air toward a central space or a lower space of the freezer compartment 13. The third grill cover 340 may be referred to as a "cold air supply duct" in that the third grill cover 340 may extend downward from the first grill cover 320 and supply the cold air to the freezer compartment 13 through the second supply port 346.

The second grill cover 330 may be coupled to a rear or second side of the first grill cover 320. The second grill cover 330 may include a second grill cover body 331 having a plate shape. The second grill cover body 331 may include the fan seat 332 having the support couplers 332*a* coupled to the fan support 355. The fan seat 322 may be arranged at a position corresponding to the fan suction portion 322 of the first grill cover 320. The fan seat 332 may include a wire hole 332*b* through which an electric wire connected to the blower fan 350 may pass.

A first grill cover coupler or coupler 338 coupled to the first grill cover 320 may be provided in the second grill cover body 331. A predetermined fastening member or fastener may be coupled to the first grill cover coupler 338 to be fastened to a rear or second surface of the first grill cover 320. The second grill cover body 331 may include a second duct coupling part or coupler 322*c* coupled to a rear portion of the first duct coupler 327 of the first grill cover 320. The first and second duct couplers 327 and 332*c* may be coupled to the first supply duct 380.

The second grill cover 330 may include a coupling guide 337 provided below the second grill cover body 331 and coupled to the first grill cover 320. The coupling guide 337 may protrude forward from the second grill cover body 331 to support the rear or second surface of the first grill cover 320, and may be arranged to surround the second cover inserting portion 333.

The third grill cover coupler 334 coupled to the third grill cover 340 may be provided at a lower portion of the coupling guide 337. A predetermined fastening member or fastener may fasten the third grill cover coupler 334 and a fastening hole 341*a* of the third grill cover 340 to each other. The coupling guide 337 may include the second cover inserting portion 333 into which the second cover 270 or the water tray 240 may be inserted. The second cover inserting portion 333 may be formed such that front and rear sides of the coupling guide 337 may pass therethrough.

Figure 21:
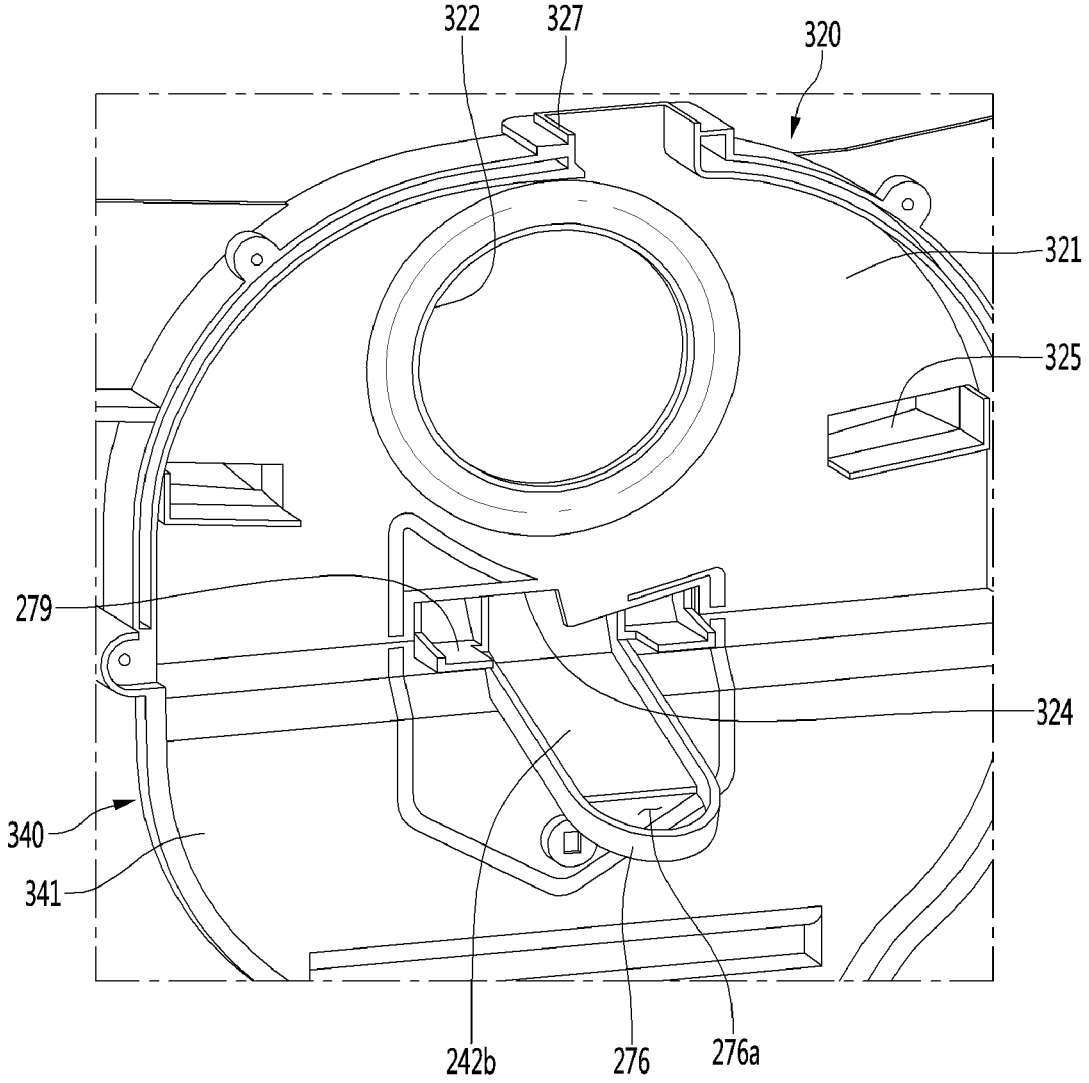
FIG. 21 is a view of a state in which the second cover of the evaporator case is arranged through first and third grill covers according to an embodiment.
Figure 22:
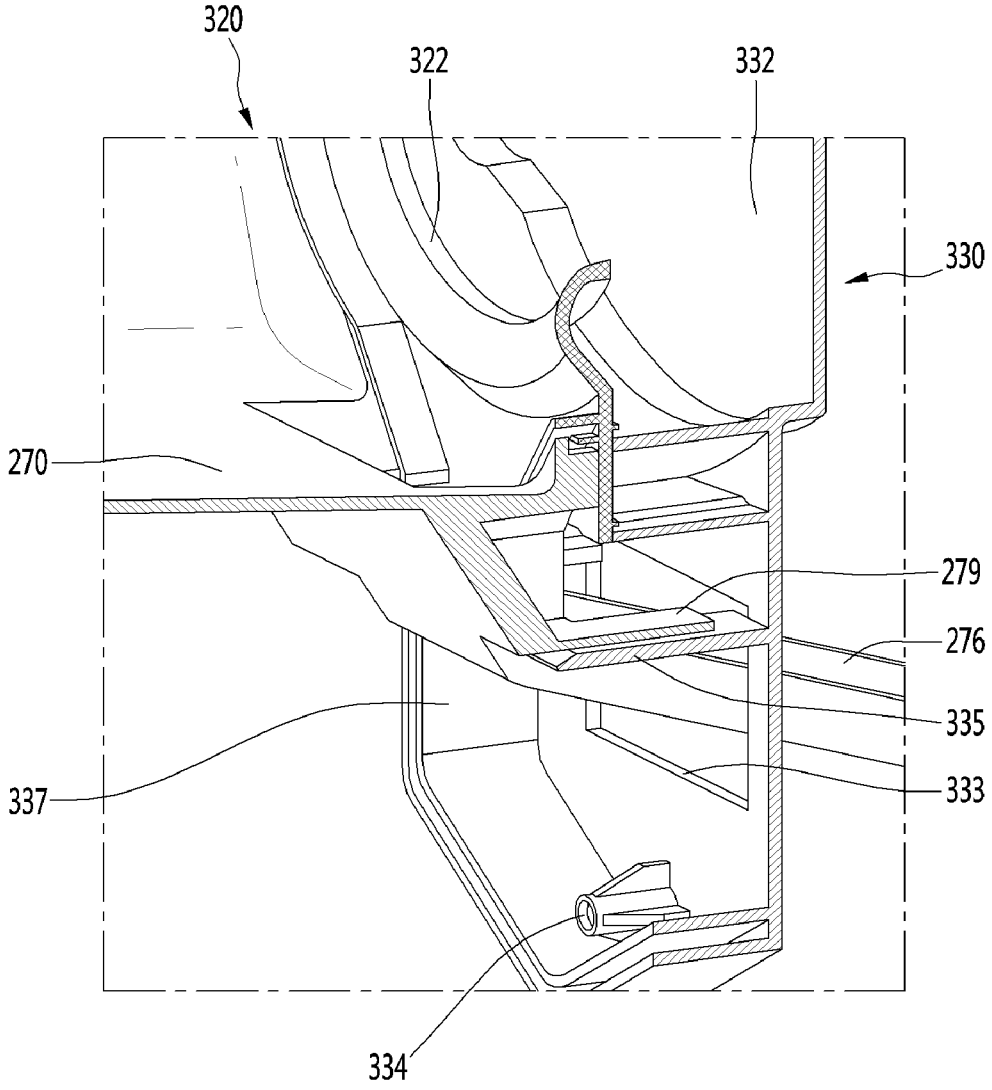
FIG. 22 is a view of a state in which the second cover of the evaporator case is arranged through the second grill cover according to an embodiment.

The coupling guide 337 may include cover support members or supports 335 that support a rear portion of the second cover 270. The cover support members 335 may be provided on one surface of the coupling guide 337 to extend in a transverse direction, and may be configured to support support protrusions 279 (see FIG. 21) provided on a rear or second side of the second cover 270. The cover support members 335 may be provided in plurality, and may extend from opposite inner surfaces of the coupling guide 337 in a transverse direction.

An upper portion of the coupling guide 337 may function as a water collector configured to collect the condensate or water generated inside the blower fan 350 or the first and second grill covers 320 and 330. Discharge guides 336*a* and 336*b* configured to discharge the condensate generated by the blower fan 350 to a lower side may be provided at an upper portion of the coupling guide 337. The discharge guides 336*a* and 336*b* may be located below the blower fan 350.

The discharge guides 336*a* and 336*b* may include a first discharge guide 336*a* and a second discharge guide 336*b* that may define or form a condensate collector. The first discharge guide 336*a* may extend from one or a first surface of the coupling guide 337 in one or a first direction, and the second discharge guide 336*b* may extend from another or second surface of the coupling guide 337 in another or second direction. For example, based on FIG. 12, the one or first surface and the other or second surface may correspond to a right surface and a left surface, respectively, and the one or first direction and the other or second direction may correspond to a leftward direction and a rightward direction.

The first discharge guide 336*a* and the second discharge guide 336*b* may be spaced apart from each other, and the space may define a condensate hole or passage 336*c*. The condensate hole 336*c* may be located above the second cover inserting portion 333. The first discharge guide 336*a* and the second discharge guide 336*b* may extend to be downwardly inclined. With respect to the horizontal surface, an inclined angle 81 of the first discharge guide 336*a* and an inclined angle 82 of the second discharge guide 336*b* may be different from each other. For example, the angle 81 may be larger than the angle 82.

A height of the first discharge guide 336*a* may be relatively higher than a height of the second discharge guide 336*b*. An uppermost height of the first discharge guide 336*a* may be higher than an uppermost height of the second discharge guide 336*b*, and a lowermost height of the first discharge guide 336*a* may be higher than a lowermost height of the second discharge guide 336*b*.

An extension direction of the first discharge guide 336*a* and an extension direction of the second discharge guide 336*b* may intersect each other. The first discharge guide 336*a* and the second discharge guide 336*b* may be arranged to vertically overlap each other. For example, a vertical virtual line 11 passing through an end of the first discharge guide 336 may pass through the second discharge guide 336*b*.

While the cold air flows through the blower fan 350, condensate may be generated around the fan assemblies 350 and 355. The condensate may be collected at or to an upper portion of the coupling guide 337 and may drop to the water tray 240 through the condensate hole 336*c*.

When the first discharge guide 336*a* and the second discharge guide 336*b* are located at a same height, and extension directions of the first and second discharge guides 336*a* and 336*b* are formed to be symmetric to each other toward the condensate hole 336*c*, cold air may leak through the condensate hole 336*c* while the blower fan 350 rotates. In this case, the condensate existing around the coupling guide 337 may be frozen. Thus, the first and second discharge guides 336*a* and 336*b* may be configured as described above so that such problems may be solved.

For example, when the blower fan 350 rotates in a clockwise direction "A" (see FIG. 12), the cold air generated by the blower fan 350 may be restrained or prevented from being discharged to the lower side through the condensate hole 336*c* by the first and second discharge guides 336*a* and 336*b* arranged to intersect each other when viewed from above. Further, the water existing on the upper side of the first discharge guide 336*a* may be discharged toward the condensate hole 336*c* in a direction or path "B", and the water existing on the upper side of the second discharge guide 336*b* may be discharged to the condensate hole 336*c* in a direction or path "C". The direction or path "B" and the direction or path "C" may be opposite to each other. According to such a structure of the first and second discharge guides 336*a* and 336*b*, the condensate may be easily discharged.

The condensate hole 336*c* may be located on an upper side of the second cover inserting portion 333, and the water tray 240 may pass through the second cover inserting portion 333 so that the water dropped through the condensate hole 336*c* may be collected in the water tray 240. According to such a configuration, the condensate generated by the fan assemblies 350 and 355 may be easily discharged.

The flow supplier 300 may further include discharge ducts 311 coupled to the evaporator cases 210 and 270 to guide the cold air stored in the refrigerator compartment 12 to insides of the evaporator cases 210 and 270, that is, toward the evaporator 220. The discharge ducts 311 may be coupled to the inner refrigerator compartment case 71 to extend downward and may be coupled to the evaporator cases 210 and 270.

Discharge holes 312, which may communicate with the refrigerator compartment 12 and into which the cold air in the refrigerator compartment 12 may be introduced, may be included in upper portions of the discharge ducts 311. A plurality of panels 312*a* may be provided in the discharge holes 312 to prevent foreign matter in the refrigerator compartment 12 from being introduced into the discharge ducts 311 through the discharge holes 312. The discharge holes 312 may be understood as spaces formed between the plurality of panels 312*a* that may form a grill.

Evaporator supply parts or ports 313 coupled to the evaporator cases 210 and 270 to introduce the cold air discharged from the refrigerator compartment 12 into the installation space for the evaporator 220 may be formed at lower portions of the discharge ducts 311. For example, the evaporator supply ports 313 may be coupled to the first duct couplers 217 of the first cover 210.

The discharge ducts 311 may be provided on opposite sides of the evaporator cases 210 and 270. Thus, the cold air stored in the refrigerator compartment 12 may be discharged to opposite sides of the inner refrigerator compartment case 71 and may be supplied to insides of the evaporator cases 210 and 270 through the discharge ducts 311. Further, the supplied cold air may be cooled while passing through the evaporator 220.

The flow supplier 300 may include a first supply duct 380 through which at least a portion of the cold air having passed through the blower fan 350 may flow. The first supply duct 380 may be coupled to the duct couplers 327 and 332*c* to guide flow of the cold air to be supplied to the refrigerator compartment 12. The duct couplers 327 and 332*c* may be inserted into the grill cover coupler 218.

A cold air duct connector 382 connected to the refrigerator compartment cold air duct 81 may be formed at an upper portion of the first supply duct 380. The cold air flowing through the first supply duct 380 may be introduced into the refrigerator compartment cold air duct 81 to flow upward and may be supplied to the refrigerator compartment 12 through the refrigerator compartment cold air supplying vents 82.

The third grill cover 340 may include a cover duct 349 through which at least a portion of the cold air passing through the blower fan 350 may flow. The cover duct 349 may guide flow of the cold air to be supplied to the freezer compartment 13, and may define a lower configuration of the third grill cover 340. A duct supply part or port 349*a* configured to discharge the cold air to the freezer compartment 13 may be formed at a lower portion of the cover duct 349.

A portion of the cold air passing through the blower fan 350 may flow upward and may be supplied to the refrigerator compartment 12 through the first supply duct 380. Remaining cold air may flow to opposite sides of the blower fan 350, and a portion of the remaining cold air may be supplied to an upper space of the freezer compartment 13 through the plurality of first supply ports 325.

The cold air not supplied through the first supply ports 325 may flow further downward and may be supplied to a central space of the freezer compartment 13 through the second supply port 346. The cold air not supplied through the second supply port 346 may flow further downward, may be introduced into the cover duct 349, and may be supplied to a lower space of the freezer compartment 13 through the duct supply port 349*a*.

Figure 13:
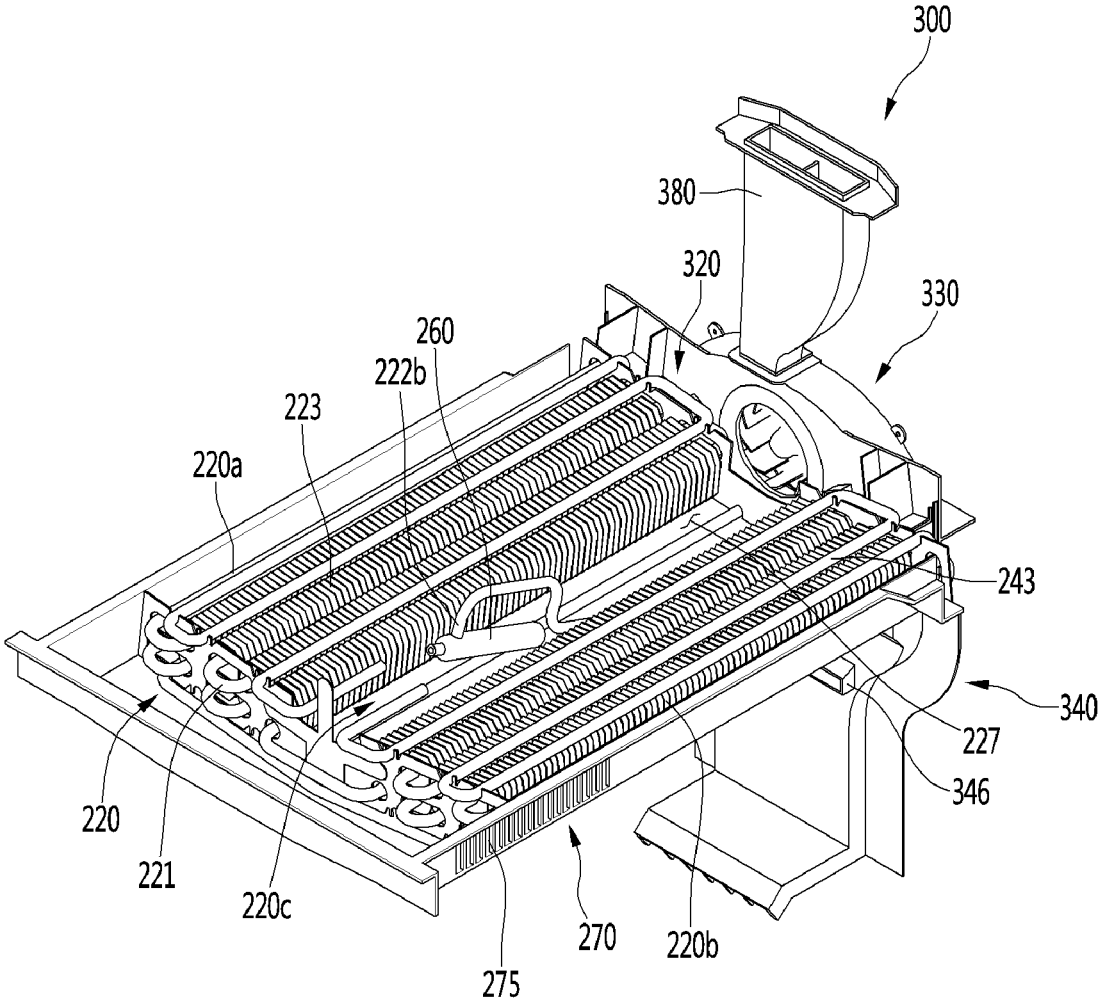
FIG. 13 is a view of an evaporator and a flow supply installed in a second cover of evaporator cases according to an embodiment.
Figure 14:
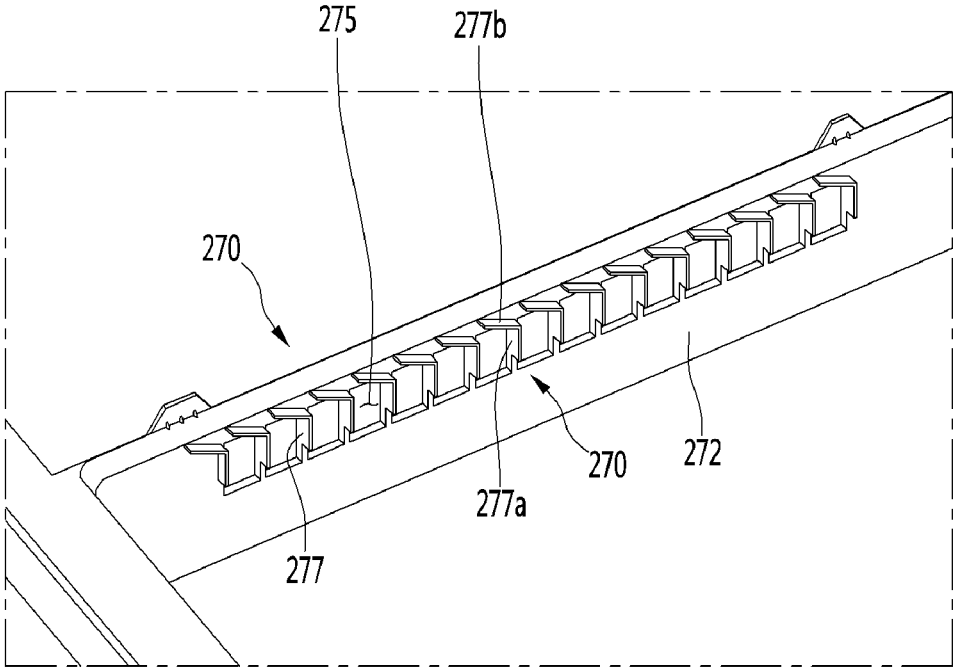
FIG. 14 is a view of a side surface of the second cover of FIG. 13.
Figure 15:
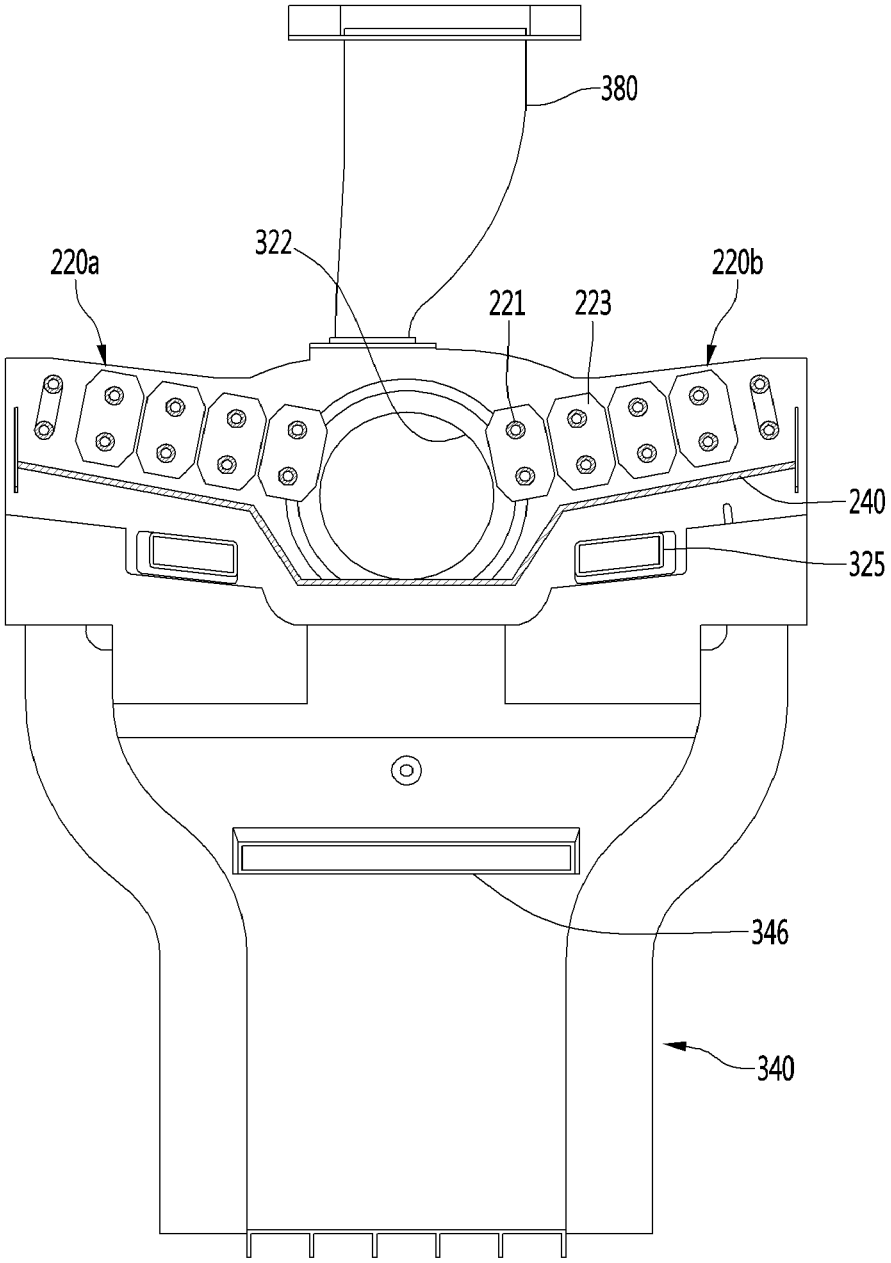
FIG. 15 is a sectional view of the evaporator, a water tray, and the flow supply according to an embodiment.

Referring to FIG. 13 to FIG. 15, the cold air supplier 100 may include the evaporator 220 installed inside the evaporator cases 210 and 270. The evaporator 220 may include the refrigerant pipes 221 through which the refrigerant flows and the fins 223 coupled to the refrigerant pipes 221. The refrigerant pipes 221 may be shaped to be bent several times, may extend transversely, and may be vertically arranged in a plurality of rows. According to such a configuration, a flow distance of the refrigerant may be increased, so that a heat exchange amount may be increased.

The fins 223 may vertically extend to be coupled to the rowed refrigerant pipes 221 and may guide flow of the cold air to promote heat exchange between the cold air and the refrigerant. Due to the refrigerant pipes 221 and the fins 223, a heat exchange performance of the refrigerant may be improved.

The fins 223 may be provided in plurality. A plurality of fins 223 may be spaced apart from each other in a frontward-rearward direction. At least some of the plurality of fins 223 may extend from lateral sides toward a central side or center of the evaporator 220 to guide flow of the cold air from the lateral sides to the central side.

The gas-liquid separator 260, which may be configured to separate a gas refrigerant of the refrigerant passing through the evaporator 220 and supply the separated gas refrigerant to the suction pipe 290, may be installed in an exit or end of an outlet pipe 222*b*. The gas-liquid separator 260 may be installed in a fan suction passage 227. According to such arrangement of the gas-liquid separator 260, the gas-liquid separator 260 may be arranged at a relatively low position, and accordingly, a vertical height of the cold air supplier 100 may be reduced.

The evaporator 220 may further include the first heater 243 coupled to an upper portion of the refrigerant pipes 221 to provide a predetermined amount of heat to the evaporator 220 at a defrosting time of the evaporator 220 so as to melt ice frosted in the refrigerant pipes 221 or the fins 223.

The evaporator 220 may include sides that define opposite portions of the evaporator 220 and a central part or portion 220*c* of the evaporator 220. The sides may include a plurality of heat exchangers 220*a* and 220*b*. The central portion 220*c* may include the fan suction passage 227 formed between the plurality of heat exchangers 220*a* and 220*b* to define a suction-side passage of the blower fan 350.

The plurality of heat exchangers 220*a* and 220*b* may include a first exchanger 220*a* and a second heat exchanger 220*b*. The fan suction passage 227 may be understood as a cold air passage not having the refrigerant pipes 221 and the fins 223. According to such a configuration, the cold air cooled while passing through the first and second heat exchangers 220*a* and 220*b* may be joined at or in the fan suction passage 227 and may flow toward the blower fan 350. The first and second heat exchangers 220*a* and 220*b* may include the refrigerant pipes 221 and the fins 223.

The cold air supplier 100 may include the first holder 231 that supports a front or first portion of the evaporator 220 and the second holder 233 that supports a rear or second portion of the evaporator 220. The first holder 231 or the second holder 233 may include through-holes 234*b* on which the refrigerant pipes 221 are supported (see FIG. 17).

The first and second covers 231 and 233 may be supported on opposite sides of the second cover 270. Holder supports 272*a* (see FIG. 17) that support the first holder 231 or the second holder 233 may be provided on side surfaces of the second cover 270, that is, second side covers 272. The holder supports 272*a* may include ribs provided on inner surfaces of the second side covers 272 and having insertion holes such that at least a portion of the first holder 231 or the second holder 233 may be inserted thereinto.

Side guides 277 may be provided in the second side covers 272. The side guides 277 may include a plurality of ribs or panels that define the cover discharge holes 275. The plurality of ribs may be spaced apart from each other in a frontward-rearward direction. Each of the side guides 277 may include a first guide extension 277*a* that extends upward from a lower end of the corresponding cover discharge hole 275 and a second guide extension 277*b* that extends from the first guide extension 277*a* to be inclined upward.

The condensate existing in the evaporator cases 210 and 270 or the water generated while ice is melted may be discharged through the water tray 240. When water existing adjacent to the cover discharge holes 275 is discharged to the outside through the cover discharge holes 275, the water may be introduced into the storage chambers of the refrigerator 10. When the blower fan 350 is switched off so that the flow of the cold air into the cover discharge holes 275 does not occur, this problem may become even more serious. Thus, as the side guides 277 may be provided inside the cover discharge holes 275, the water existing on the upper side of the second cover 270 may be easily discharged to the lower side, so that the water may be prevented from being introduced into the storage chambers of the refrigerator 10.

The first heat exchanger 220*a* and the second heat exchanger 220*b* may extend from the central portion 220*c* to the sides of the evaporator 220 to intersect each other. The first heat exchanger 220*a* and the second heat exchanger 220*b* may be upward inclined toward lateral sides with respect to the fan suction passage 227.

According to a configuration of the evaporator 220, a vertical width of the cold air supplier 100 may be relatively reduced, so that a storage space of the freezer compartment 13 may be relatively increased. The vertical width of the cold air supplier 100 may not be large, so that the relatively large thickness of the partition wall insulator 55 located in the partition wall 50 may be secured. As a result, even while the thickness of the partition wall insulator 55 is increased relatively, an entire thicknesses of the partition wall 50 and the cold air supplier 100 may be reduced. Further, as compared with an evaporator horizontally arranged in a transverse direction, the heat exchange area of the evaporator 220 may be increased relatively, so that heat exchange performance may be improved. According to a configuration in which the evaporator 220 is inclined in a V shape, the first and second holders 231 and 233 that support a front or first portion and a rear or second portion of the evaporator 220 may be also upward inclined from a central portion toward opposite sides thereof.

The water tray 240 configured to collect the water generated by the evaporator 220 may be installed on a lower side of the evaporator 220. The water tray 240 may be spaced downward apart from a lower end of the evaporator 220 to store the water dropped from the evaporator 220. The water tray 240 may have a water collecting surface downwardly inclined to correspond to an inclined arrangement of the evaporator 220.

Figure 16:
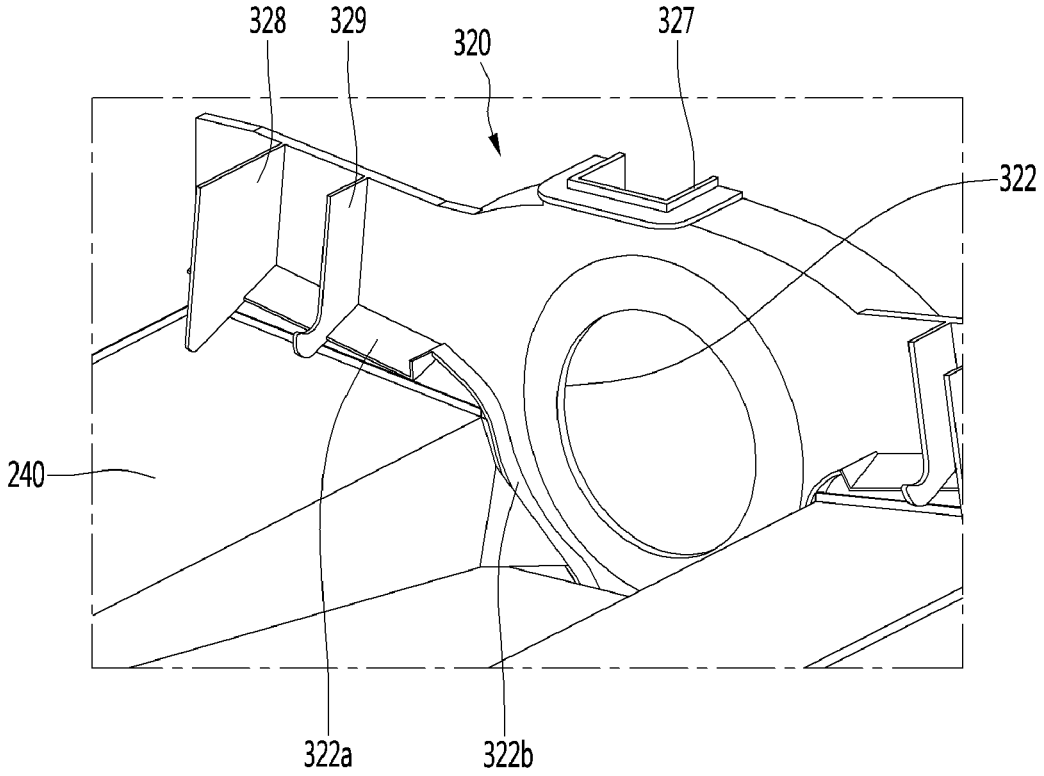
FIG. 16 is a view of a rear portion of the water tray and of the first grill cover.
Figure 17:
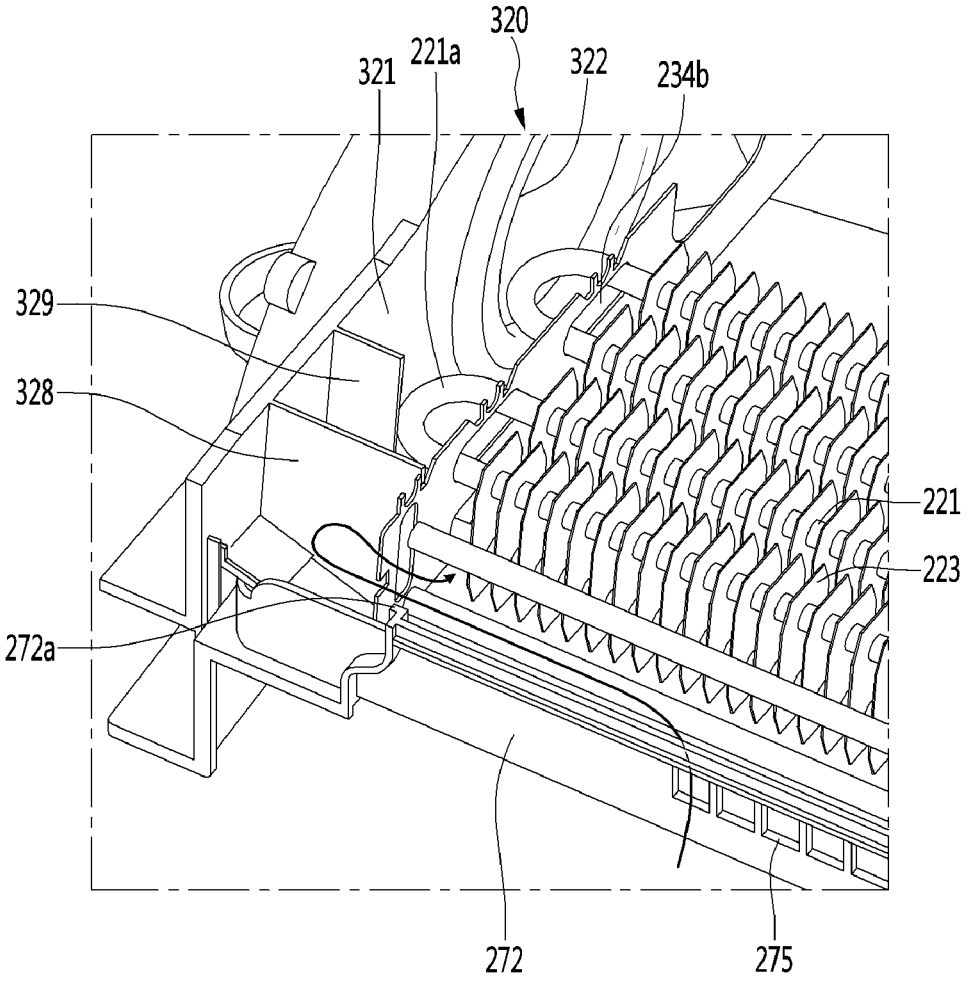
FIG. 17 is a view of a rear portion of the evaporator and of the first grill cover.
Figure 18:
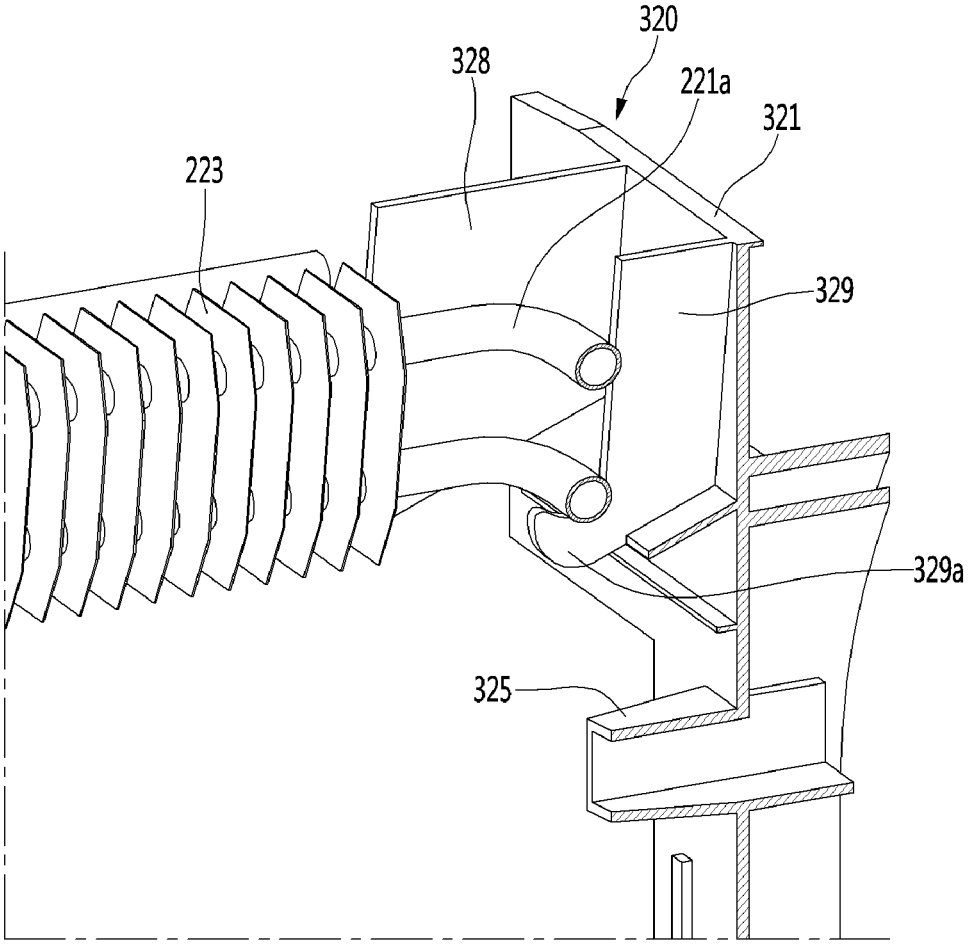
FIG. 18 is a sectional view of a state in which a refrigerant pipe of the evaporator is supported on the first grill cover according to an embodiment.
Figure 19:
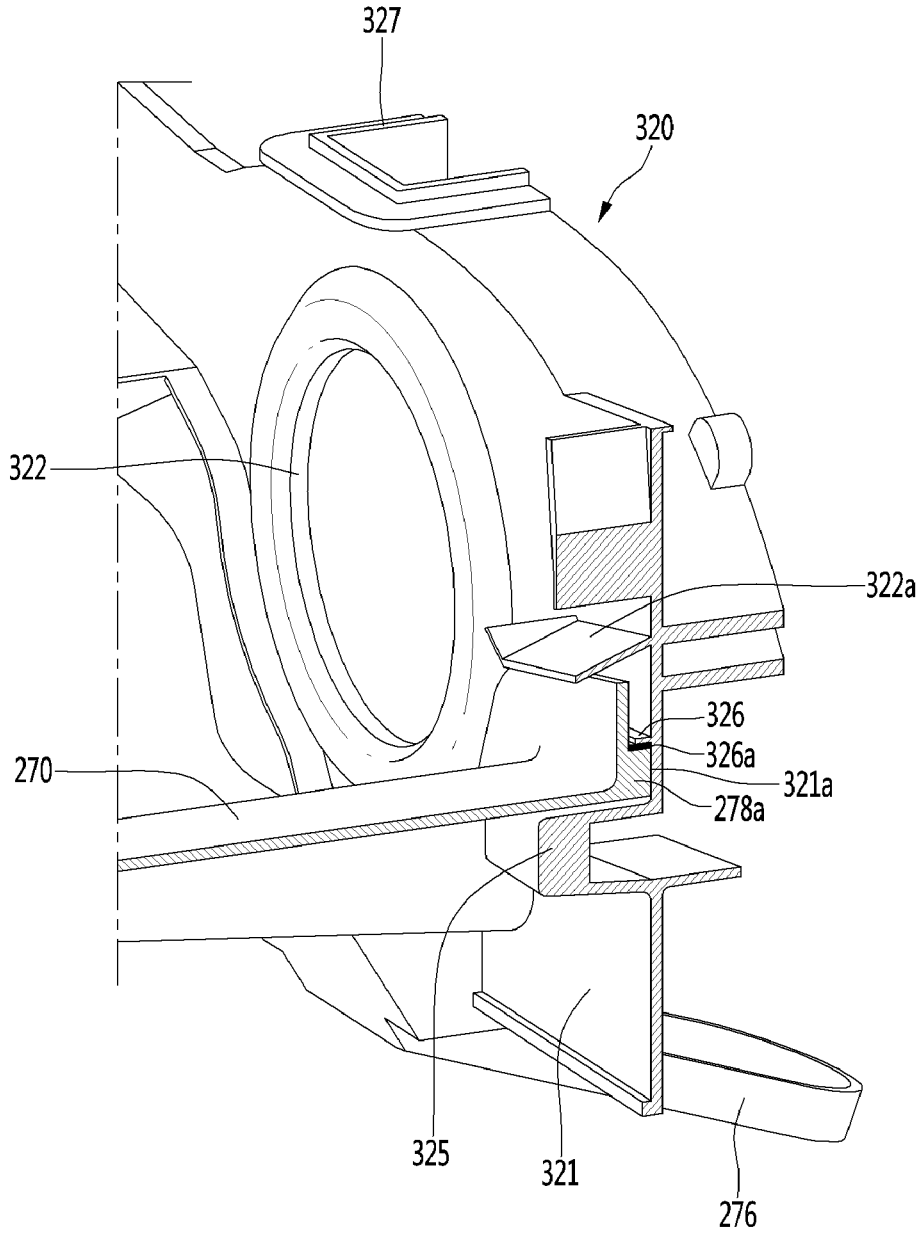
FIG. 19 is a sectional view of a state in which the second cover and the first grill cover are coupled to each other according to an embodiment.
Figure 20:
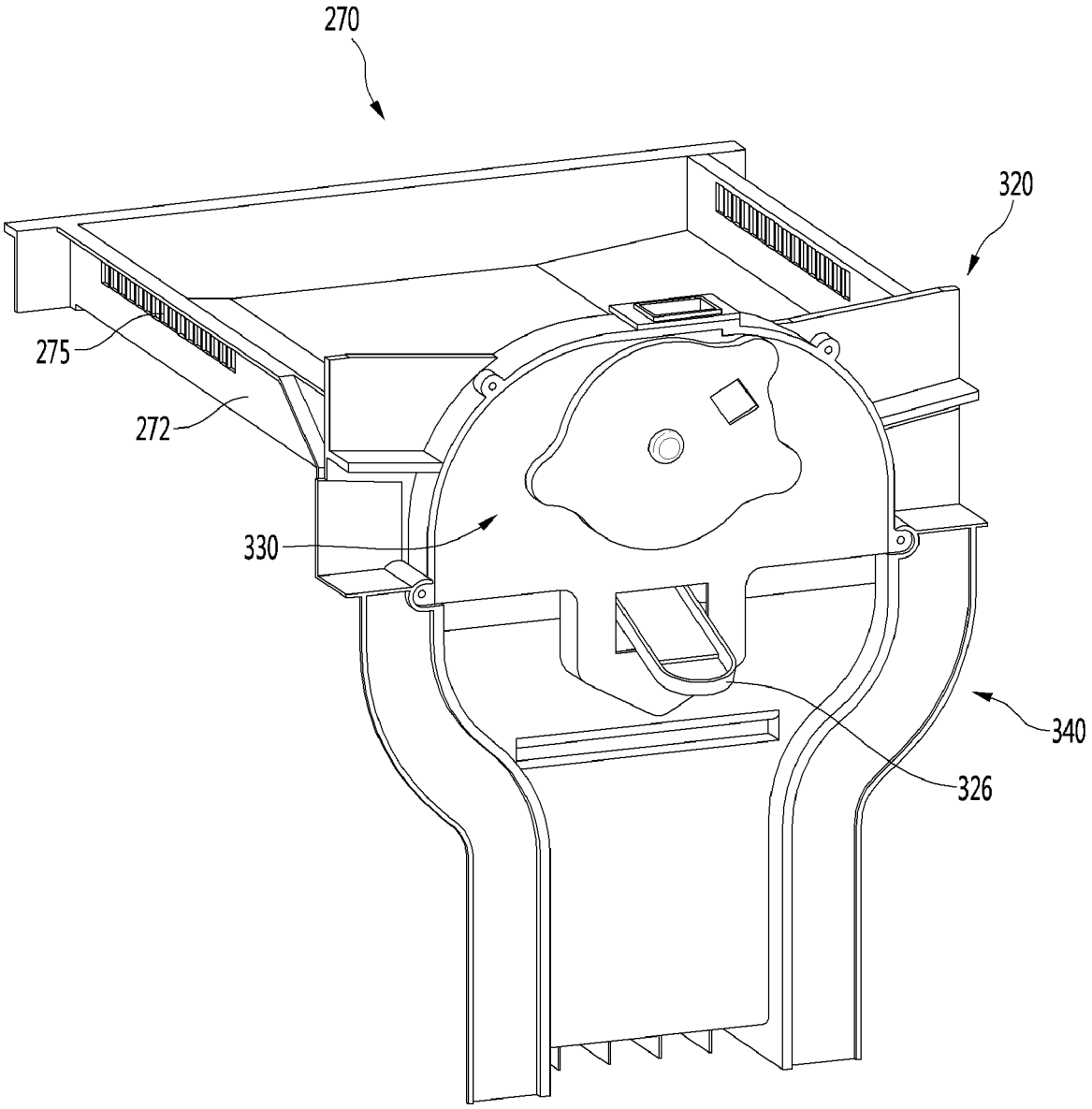
FIG. 20 is a rear perspective view of a state in which the flow supply part is coupled to the second cover of an evaporator case according to an embodiment.

Referring to FIG. 16 to FIG. 18, the water tray 240 may be arranged on a front side of the first grill cover 320, and the condensate or the water collected in the water tray 240 may flow to the rear or second side of the grill covers 320, 330, and 340 through the first cover inserting portion 324, 342, and 344, and the second cover inserting portion 333. The water on the front surface of the first grill cover 320 may be collected in the water tray 240 along the condensate guides 322*a* and 322*b*.

The blocking shields 328 may be provided on the front or first surface of the first grill cover 320. The blocking shields 328 may be arranged on a rear or second side of the second holder 233 that supports a rear or second portion of the evaporator 220. In other words, the blocking shields 328 may be arranged to block a space between the front surface of the first grill cover 320 and the second holder 233. For example, the blocking shields 328 may support a rear or second portion of the second holder 233. The blocking shields 328 may be located closer to side surfaces of the first grill cover 320 than the support guides 329. The support guides 329 may be located between the blocking shields 328 and the fan suction portion 322. Thus, the blocking shields 328 may prevent the cold air from flowing from lateral sides of the evaporator 220 toward the fan suction portion 322.

According to such an arrangement of the blocking shields 328, a space formed between the first grill cover 320 and the evaporator 220 may be limited in function as a cold air passage. Thus, because the cold air suctioned by the cover discharge holes 275 and flowing to the rear side may be blocked by the blocking shields 328, the cold air may fail to flow to the fan suction portion 322 and may flow to pass through the evaporator 220. As a result, the cold air introduced into the evaporator cases 210 and 270 may be restrained or prevented from bypassing the evaporator 220, so that heat exchange efficiency through the evaporator 220 may be improved.

The support guides 329 may be provided on the front surface of the first grill cover 320. The support guides 329 may be arranged to be spaced apart from the blocking shields 328 toward the fan suction portion 322. The support guides 329 may include first pipe supports 329*a* that support bent pipes 221*a* of the refrigerant pipes 221, which may protrude to or out from the rear or second side of the second holder 233. The first pipe support 329*a* may be provided below the support guides 329, may have a downward recessed shape, and may stably support the bent pipes 221*a*. As a result, the rear portion of the evaporator 220 may be stably supported on the first grill cover 320.

Referring to FIG. 19 to FIG. 22, the second cover 270 may support a lower side of the water tray 240. The second cover 270 may pass through the first cover inserting portion 324, 342, and 344 and the second cover inserting portion 333 together with the water tray 240 to extend toward the rear or second side of the grill covers 320, 330, and 340, and may communicate with the drain pipe 295.

The second cover 270 may be mounted on the front or first surface of the first grill cover 320 while moving from the front or first side to the rear or second side of the first grill cover 320. Grill cover mounting parts or mounts 278*a* inserted into spaces between the mounting guides 326 of the first grill cover 320 and the first supply ports 325 may be provided at rear portions of the second cover 270. The first grill cover 320 may include insertion parts or portions 321*a*, which may be provided between the mounting guides 326 and the first supply ports 325 and into which the grill cover mounts 278*a* may be inserted.

The second cover 270 may be supported on or at upper portions of the first supply ports 325. The first supply ports 325 may protrude forward from the first grill cover body 321, and at least a portion of the bottom surface of the second cover 270 may be seated on upper surfaces of the first supply ports 325. The bottom surface of the second cover 270 may be seated on the first supply ports 325, and the grill cover mounts 278*a* may be mounted on the insertion portions 321*a*, so that the second cover 270 may be stably supported on the first grill cover 320. Thus, the water tray 240 supported by the second cover 270 may be also stably supported on the first grill cover 320.

The sealing members or seals 326*a* may be arranged between the grill cover mounts 278*a* and the mounting guides 326. That is, the seals 326*a* may be provided below the mounting guides 326, and may be in close contact with the upper surfaces of the grill cover mounts 278*a*. Due to the seals 326*a*, water leakage along spaces between the second cover 270 and the mounting guides 326 may be stabilized, and the second cover 270 may be more stably supported on the first grill cover 320.

A cover guide 276 that supports a pipe inserting part or insertion area 242*b* of the water tray 240 may be included in the rear or second portion of the second cover 270. The pipe insertion area 242*b* may be a part that protrudes rearward from a body of the water tray 240. A shape of the cover guide 276 may correspond to a shape of the second guide 242*b*.

At least some portions of the pipe insertion area 242*b* and the cover guide 276 may be inserted into the drain pipe 295. To achieve this, left-right widths of the pipe insertion area 242*b* and the cover guide 276 may be smaller than a diameter of an inlet of the drain pipe 295. Thus, while the water is discharged, the water may be prevented from being leaked to an outside of the drain pipe 295.

A discharge hole 276*a*, through which water flowing through the pipe insertion area 242*b* may be discharged to the drain pipe 295, may be formed in the cover guide 276. The discharge hole 276*a* may be formed on a rear or second side of the pipe insertion area 242*b*. The water flowing through the pipe insertion area 242*b* may be discharged to the drain pipe 295 through the discharge hole 276*a*.

The second cover 270 may further include support protrusions 279 provided on opposite sides of the cover guide 276. The support protrusions 279 may be supported by the cover supports 335 of the second grill cover 330. The support protrusions 279 may be supported by the cover supports 335, so that the second cover 270 and the water tray 240 may be stably supported on the second grill cover 330. The first supply ports 325, the mounting guides 326, and the cover supports 335 may together be referred to as a "cover support" or a "tray support" in that they support the second cover 270 or the water tray 240.

Figure 23:
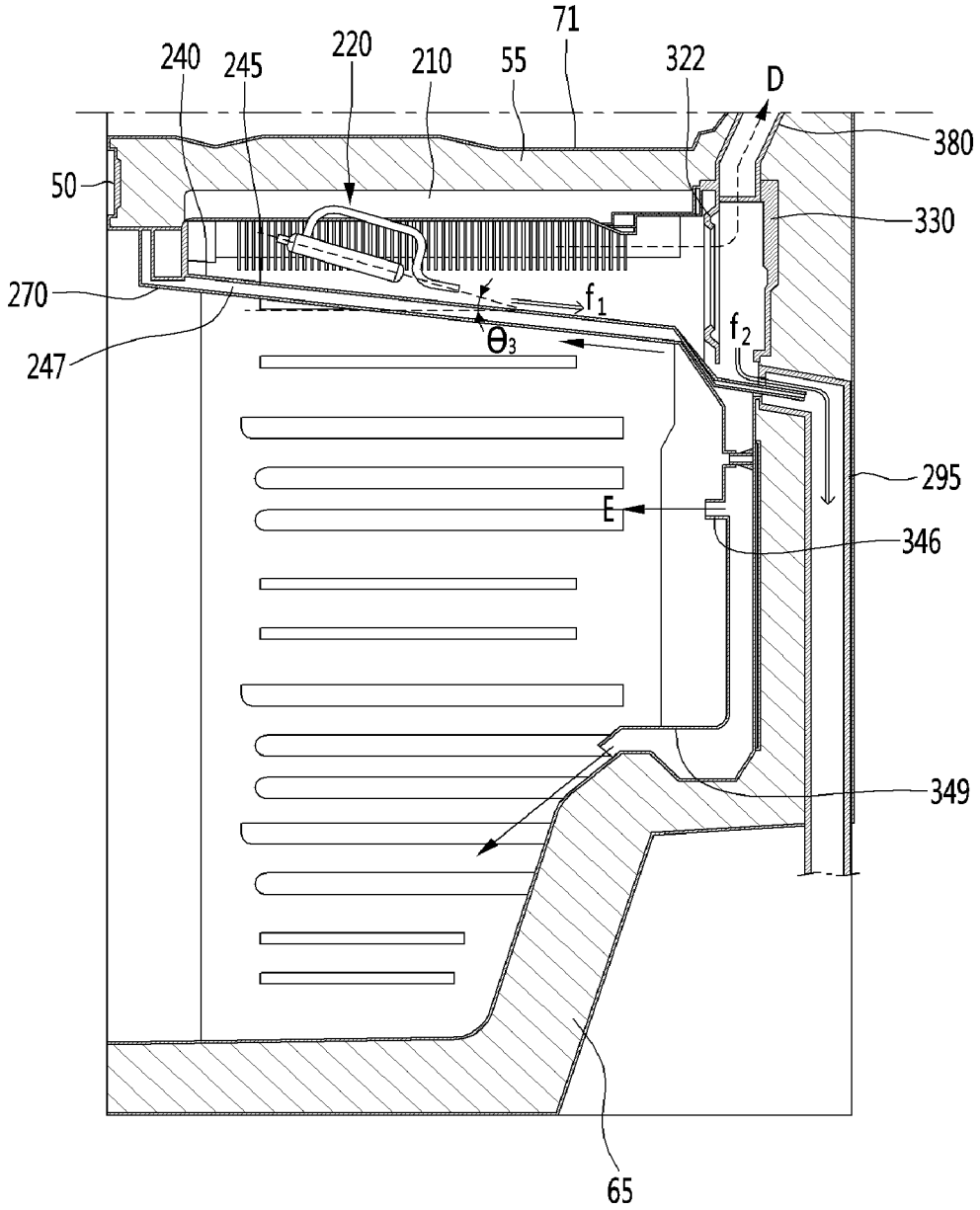
FIG. 23 is a view of a state in which water generated by the evaporator is discharged according to an embodiment.
Figure 24:
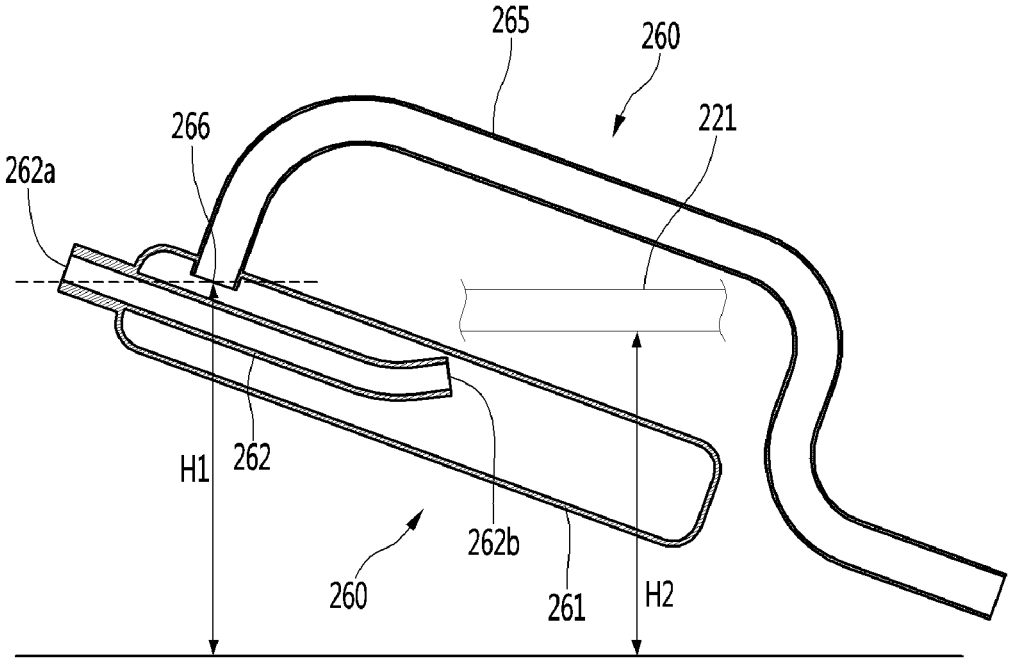
FIG. 24 is a view of a gas-liquid separator according to an embodiment.

Referring to FIG. 23 and FIG. 24, the refrigerator 10 may include the gas-liquid separator 260 arranged at an exit or end of the evaporator 220 to separate a gas refrigerant of the refrigerant passing through the evaporator 220 and supply the gas refrigerant to the suction pipe 290. The gas-liquid separator 260 may be arranged in the fan suction passage 227 and may be arranged to be upward inclined by a setting or predetermined angle 83 with respect to a horizontal surface. Considering the function of the gas-liquid separator 260, the gas-liquid separator 260 may be arranged to extend upward in a vertical direction, and a port through which the gas refrigerant may be discharged may be arranged at an upper portion of the gas-liquid separator 260. This is because even while the gas refrigerant separated by the gas-liquid separator 260 is discharged, a liquid refrigerant stored in the gas-liquid separator 260 may be prevented from being discharged.

However, if the gas-liquid separator 260 is arranged to extend upward in a vertical direction, a vertical height of the cold air supplier 100 may increase, and accordingly, a height of the partition wall 50 may increase. Thus, the gas-liquid separator 260 may be upwardly inclined by the predetermined angle 83 with respect to the horizontal surface such that even when the height of the cold air supplier 100 is reduced, a function of the gas-liquid separator 260 may be easily performed. For example, the predetermined angle 83 may be formed in a range of 20-40 degrees.

The gas-liquid separator 260 may include a gas-liquid separating body 261 configured to store the refrigerant. The gas-liquid separating body 261 may extend to be upward inclined by the predetermined angle 83 with respect to the horizontal surface. The gas-liquid separator 260 may include a refrigerant inlet 262, which may be provided above the gas-liquid separating body 261 and into which the refrigerant evaporated by the evaporator 220 may be introduced. The refrigerant inlet 262 may include a pipe, and the pipe may be inserted from an upper portion of the gas-liquid separating body 261 to extend to an inside of the gas-liquid separating body 261. The refrigerant inlet 262 may also extend to be upwardly inclined with respect to the horizontal surface.

The refrigerant inlet 262 may include an inlet or first end 262*a* and an outlet or second end 262*b*. The inlet 262*a* may be where the refrigerant is guided into the refrigerant inlet 262, and the outlet 262*b* may be where the refrigerant introduced through the refrigerant inlet 262 is discharged into the gas-liquid separating body 261. The inlet 262*a* may be located outside the gas-liquid separating body 261, and the outlet 262*b* may be located inside the gas-liquid separating body 261.

The gas-liquid separator 260 may further include a gas refrigerant discharge part or pipe 265 through which the gas refrigerant among the refrigerant stored in the gas-liquid separating body 261 may be discharged. The gas refrigerant discharge pipe 265 may be connected to the suction pipe 290. The gas refrigerant discharge pipe 265 may include a discharge port 266 through which the refrigerant stored in the gas-liquid separating body 261 may be introduced into the gas refrigerant discharging pipe 265.

A height of the discharge port 266 may be higher than a height of an outlet pipe 221 of the evaporator 220. For example, a height H1 of the discharge port 266 with respect to a predetermined reference surface may be higher than a height H2 of the outlet pipe 221 of the evaporator 220. When the height H1 is lower than the height H2, because a head pressure of the outlet pipe 221 of the evaporator 220 becomes larger than a head pressure of the refrigerant stored in the gas-liquid separating body 261, the refrigerant of the gas-liquid separating body 261 may be introduced into the gas refrigerant discharge part 265 through the discharge port 266. Thus, a size and inclination angle of the gas-liquid separator 260 may be determined such that the height H1 may be higher than the height H2.

Referring to FIG. 23, the cold air stored in the storage chambers 12 and 13 may be introduced into an evaporation chamber in which the evaporator 220 may be located. The cold air stored in the refrigerator compartment 12 may be introduced into the evaporation chamber through the discharge ducts 311 constituting the refrigerator compartment suction passage (dotted line arrow). Further, the cold air stored in the freezer compartment 13 may be introduced into the evaporation chamber through the cover discharge holes 275 constituting the freezer compartment suction passage. Such flow of the cold air may be performed on opposite sides of the evaporator 220 through the first and second heat exchangers 220*a* and 220*b*. The cold air introduced from the opposite sides of the evaporator 220 may pass through the refrigerant pipes 221 and the fins 223, may be combined with each other in the fan suction passage 227, and then may flow rearward.

Further, the cold air of the fan suction passage 227 may be introduced into the grill covers 320, 330, and 340 through the fan suction portion 322 and may pass through the blower fan 350. At least a portion of the cold air passing through the blower fan 350 may flow to the refrigerator compartment cold air duct 81 through the first supply duct 380 and may be supplied to the refrigerator compartment 12 through the cold air supplying vents 82 (flow path "D). The remaining cold air among the cold air passing through the blower fan 350 may flow to the first and second supply ports 325 and 326 or the cover duct 349 and may be supplied to the freezer compartment 13 (flow path "E").

While the cold air is supplied through the evaporator 220, the condensate or the water flow may be generated by the evaporator 220, and the condensate or the water may drop to the water tray 240 provided below the evaporator 220. The water collected in the water tray 240 may flow toward the rear or second side of the water tray 240 (see flow path $f_1$). As described above, the water tray 240 may be downwardly inclined from the front or first side toward the rear or second side thereof, so that the condensate or the water may easily flow. The water flowing through or down the water tray 240 may pass through the grill covers 320, 330, and 340, and may be introduced into the drain pipe 295.

The condensate generated by the blower fan 350 or in the grill covers 320 and 330 may drop to the water tray 240 through the condensate hole 336*c* and may be introduced into the drain pipe 295 (see flow path $f_2$). That is, the water in flow path f1 and the condensate in flow path f2 may be combined with each other in the defrosting water tray 240 and may be introduced into the drain pipe 295. The water introduced into the drain pipe 295 may flow downward to be introduced into the machine room 80, and may be collected in the drain pan 85 (see FIG. 25) provided in the machine room 80.

Figure 25:
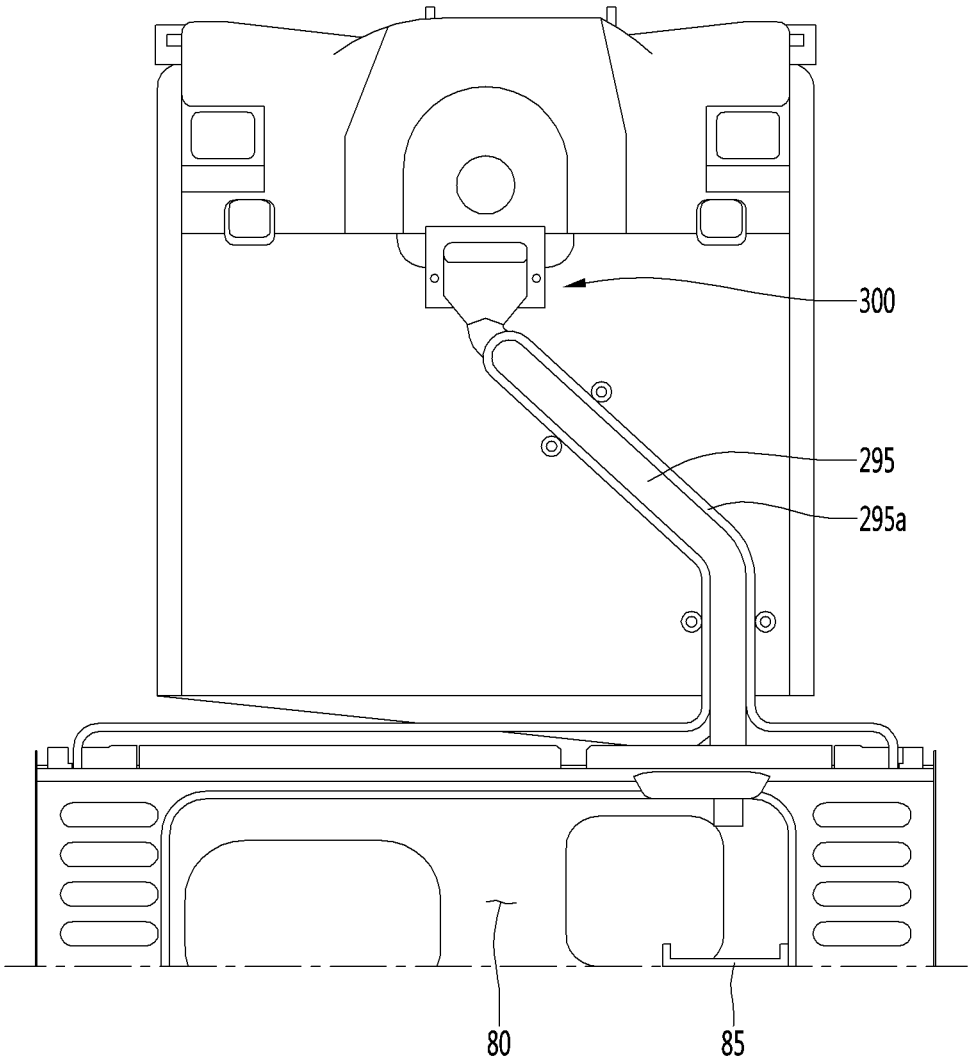
FIG. 25 is a view of a state in which a heat supply pipe is coupled to a drain pipe according to an embodiment.
Figure 26:
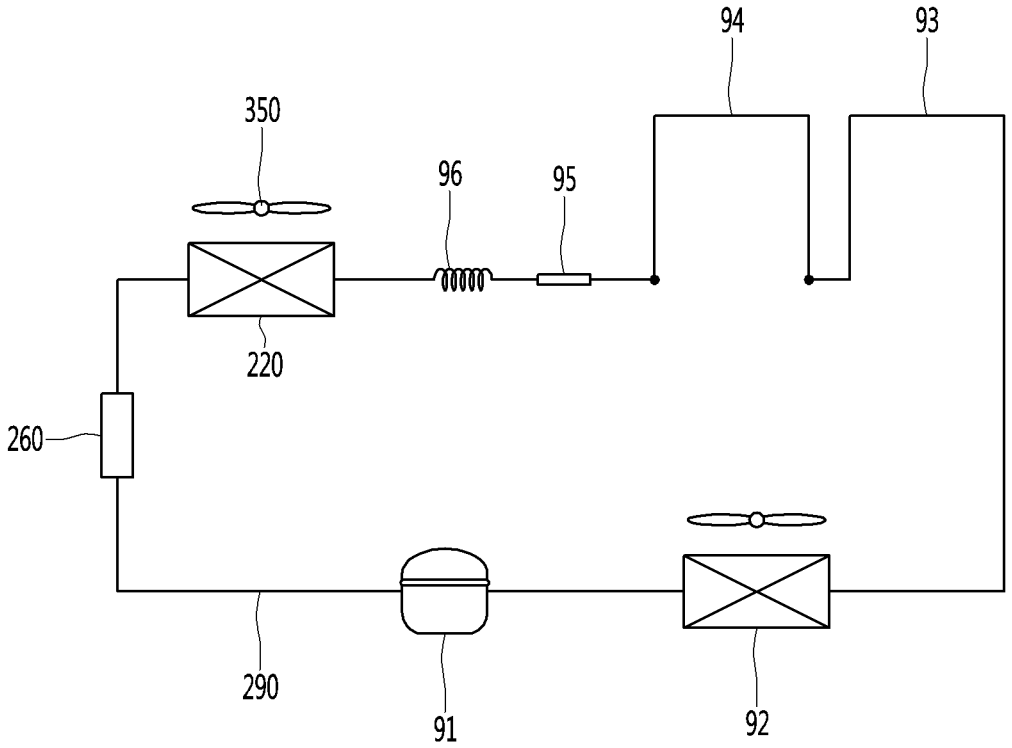
FIG. 26 is a schematic view of a refrigeration cycle of the refrigerator according to an embodiment.

Referring to FIG. 25 and FIG. 26, the refrigerator 10 may include a compressor 91 configured to compress a refrigerant, a condenser arranged in or at an outlet side of the compressor 91 to condense the compressed refrigerant, an expansion device 96 configured to decompress the refrigerant condensed by the condenser 92, and the evaporator 220 configured to evaporate the refrigerant decompressed by the expansion device 96. The expansion device 96 may include a capillary tube. The gas-liquid separator 260 configured to separate the gas refrigerant among the evaporated refrigerant and guide the separated gas refrigerant to the suction pipe 290 of the compressor 91 may be provided in an outlet side of the evaporator 220.

The refrigerator 10 may further include a dryer 95 configured to filter or remove moisture or foreign matter from the refrigerant condensed by the condenser 92. The dryer 95 may be provided on an outlet side of the condenser 92 and on an inlet side of the expansion device 96.

The refrigerator 10 may further include a first hot line pipe 93 which may extend from the outlet side of the condenser 92 to a front surface of the cabinet 11 and through which condensed refrigerant may flow. The first hot line pipe 93 may have a portion with which the doors 21 and 22 on the front surface of the cabinet 11 may be in close contact to prevent dew from occurring in the cabinet 11 due to a temperature difference between the inside and the outside of the storage chambers 12 and 13.

The refrigerator 10 may further include a second hot line pipe 94 through which the refrigerant condensed by the condenser 92 may flow and which may prevent the drain pipe 295 from being frozen. Because the drain pipe 295 may be embedded or provided in or on the rear or second surface of the freezer compartment 13, the drain pipe 295 may have a relatively low temperature. Thus, the drain pipe 295 may be frozen, and when freezing is performed, defrosted water may fail to be discharged from the drain pipe 295, and may flow back to the cold air supplier 10.

Thus, the second hot line pipe 94 may be provided to supply a predetermined amount of heat to the drain pipe 295 so as to prevent the drain pipe 295 from being frozen. For example, the second hot line pipe 94 may extend from an outlet side of the first hot line pipe 93 and may be connected to the dryer 95. That is, the refrigerant condensed by the condenser 92 may pass through the first hot line pipe 93, and then may flow through the second hot line pipe 94. However, embodiments are not limited thereto. The second hot line pipe 94 may be connected to the outlet side of the condenser 92, and the first hot line pipe 93 may be connected to an outlet side of the second hot line pipe 94.

The second hot line pipe 94 may be arranged to be in contact with the drain pipe 295. For example, the second hot line pipe 94 may be coupled to an outer surface of the drain pipe 295 through, for example, welding. In this way, the drain pipe 295 may be prevented from being frozen using the condensed refrigerant so that costs may be reduced as compared to a case where a heater, for example, is used.

Embodiments disclosed herein may solve the above-described problems, and may provide a refrigerator in which an evaporator installing structure that may enlarge an inner storage space of the refrigerator may be utilized. Embodiments disclosed herein may also provide a refrigerator in which, even when an evaporator may be installed in a partition wall, a thickness of the partition wall may be relatively reduced.

Embodiments disclosed herein may provide a refrigerator in which a structure of an evaporator may be improved so that defrosted water may be easily discharged even while heat exchange is performed, and a height of a partition wall insulator may increase. Embodiments disclosed herein may also provide a refrigerator in which a front or first portion and a rear or second portion of the evaporator may be easily supported by an evaporator case.

Embodiments disclosed herein may provide a refrigerator in which a structure of a defrosted water tray may be improved to correspond to a structure of an evaporator so that a condensate or water generated by the evaporator is easily collected. Embodiments disclosed herein may also provide a refrigerator which may easily discharge a condensate generated near a blower fan.

Embodiments disclosed herein may provide a refrigerator in which a guide rib may be provided in an evaporator case so that the water in the evaporator case may be prevented from dropping into a storage chamber. Embodiments disclosed herein may also provide a refrigerator which may prevent freezing of a drain pipe by using a condensed refrigerant having a relatively high temperature. Embodiments disclosed herein may further provide a refrigerator which in which a gas-liquid separator configured to separate a gas refrigerant from evaporated refrigerant may be provided, and a position of the gas-liquid separator may be such that performance of the gas-liquid separator may be improved.

A refrigerator according to an embodiment of the present disclosure for achieving the above aspect may include an evaporator installed inside an evaporator case, a water tray provided below the evaporator and configured to collect water from the evaporator, a grill cover provided on a rear side of the evaporator case and accommodating a blower fan, and a tray supporting device or tray support provided in the grill cover and supporting the water tray.

The grill cover may include a first grill cover having a fan suction portion or portion configured to suction cold air passing through the evaporator and configured to guide the cold air to the blower fan. The tray supporting device may include a first supply part or portion protruding from a front surface of the first grill cover and configured to discharge the air passing through the blower fan to the second storage chamber. The defrosting water tray may be supported on an upper side of the first supply part.

The evaporator case may include a first cover provided above the evaporator, and a second cover provided below the evaporator and supporting the defrosting water tray. The second cover may be placed on an upper surface of the first supply part. The tray supporting device may further include a mounting guide protruding from the front surface of the first grill cover and supporting a rear portion of the second cover. The rear portion of the second cover may include a grill cover mounting part inserted into a space between the mounting guide and the first supply part.

The refrigerator may further include a sealing member provided between the mounting guide and the grill cover mounting part. The refrigerator may further include a condensate guide provided on the front surface of the first grill cover to guide the defrosting water or a condensate to the defrosting water tray.

The condensate guide may include first guides extending from opposite sides of the front surface of the first grill cover toward a central portion of the first grill cover to be downward inclined. The first guides may extend forward from the front surface of the first grill cover to be downward inclined. The condensate guide may further include second guides extending downward from opposite sides of the fan suction portion. The second guides may be connected to the first guides and may extend toward the central portion of the first grill cover.

The grill cover may further include a second grill cover coupled to a rear portion of the first grill cover and having a fan seat on which the blower fan is seated.

The second grill cover may include a second cover inserting part into which the defrosting water tray is inserted. The second grill cover may include a discharge guide provided on an upper side of the second cover inserting part and having a condensate hole configured to guide downward discharge of a condensate.

The discharge guide may include a first discharge guide and a second discharge guide defining the condensate hole. The first and second discharge guides may extend to be downwardly inclined. An extending or extension direction of the first discharge guide and an extending or extension direction of the second discharge guide may intersect each other. The discharge guide may be located below the blower fan.

The evaporator case may include a second cover supporting a lower portion of the evaporator, and a side portion of the second cover may include a cover discharge hole configured to introduce cold air. The side portion of the second cover may slantingly extend from an inner side of the cover discharge hole, and may include a side guide configured to guide discharge of the defrosting water.

The refrigerator may further include a drain pipe communicating with the defrosting water tray and configured to discharge water collected in the defrosting water tray, and a second hot line pipe coupled to the drain pipe and configured to provide heat. A refrigerant condensed by a condenser may flow through the second hot line pipe.

According to a refrigerator having the above-described configuration according to embodiment disclosed herein, because an evaporator may be installed on one side of a partition wall by which a refrigerator compartment and a freezer compartment may be vertically partitioned, an internal storage space of the refrigerator may be enlarged, and withdrawal distances of drawers provided in the refrigerator may be increased. Thus, storage ability for food may be improved.

The first and second heat exchangers of the evaporator may be inclined from a central portion toward lateral sides of the evaporator so that the heat exchange area of the evaporator may be increased, and a relatively large thickness of an insulator located in the partition wall may be secured. A predetermined space may be secured between the first and second heat exchangers so that it may be easy to install components, such as a gas/liquid separator, or to perform a welding operation. A defrosted water tray may be provided on a lower side of the evaporator, and the water tray may be downwardly inclined from opposite sides to the central portion to correspond to the shape of the evaporator, so that defrosting water may smoothly flow.

Because a front portion of the evaporator may be supported by a hook apparatus, and a lower portion of the evaporator may be supported by a grill cover, the evaporator may be stably supported on an interior of an evaporator case. Because a blocking part may be provided in the grill cover, cold air suctioned into the evaporator case may be prevented from bypassing the evaporator and being directly introduced into a side of a blower fan. A mounting guide is provided in the grill cover so that a defrosted water tray may be easily mounted, and the water tray may be stably supported by the mounting guide. Because a sealing member may be provided between the mounting guide and a rear side of the water tray, the water may be prevented from being leaked through a coupling portion of the water tray and the grill cover, and stable coupling between the water tray and the grill cover may be achieved.

A condensate guide may be provided in the grill cover so that a condensate occurring around the blower fan may be easily discharged to the water tray. A guide rib may be provided in the evaporator case, so that the water existing inside or on the evaporator case may be prevented from dropping into the storage chamber.

A heat supply pipe may be provided in the drain pipe, so that the drain pipe may be prevented from being frozen using a condensed refrigerant having a relatively high temperature. The height of a portion of the gas-liquid separator where a gas refrigerant is bypassed may be higher than an upper end of pipes on an outlet side of the evaporator so that a liquid refrigerant inside the gas-liquid separator may be prevented from being introduced into a suction pipe.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet having first and second storage chambers, the first storage chamber being arranged on top of the second storage chamber;

a partition wall provided between the first and second storage chambers, and having a partition wall insulator therein;

an evaporator case arranged in the second storage chamber and provided at a bottom surface of the partition wall, the evaporator case having a front side and a rear side;

an evaporator provided inside the evaporator case;

a water tray provided below the evaporator and configured to collect water from the evaporator;

a grill cover provided on the rear side of the evaporator case and configured to accommodate a blower fan, the grill cover including a first grill cover having a fan suction portion into which cold air passing through the evaporator is introduced and configured to guide the cold air to the blower fan; and at least one first supply port provided on the first grill cover and configured to discharge the cold air passing through the blower fan to the second storage chamber, the at least one first supply port including a top that protrudes from a front surface of the first grill cover, a bottom that protrudes from the front surface of the first grill cover and an opening formed between the top and the bottom and through which the cold air is discharged, wherein the water tray is supported on the top of the at least one first supply port.

2. The refrigerator of claim 1, wherein the evaporator case includes:

a first cover provided above the evaporator; and a second cover provided below the evaporator to support the water tray.

3. The refrigerator of claim 2, wherein the second cover is located on an upper surface of the at least one first supply port.

4. The refrigerator of claim 2, wherein a mounting guide protrudes from the front surface of the first grill cover, and wherein a rear portion of the second cover is provided between the at least one first supply port and the mounting guide.

5. The refrigerator of claim 4, wherein the rear portion of the second cover includes a grill cover mount inserted into a space between the mounting guide and the at least one first supply port.

6. The refrigerator of claim 5, further comprising a seal provided between the mounting guide and the grill cover mount.

7. The refrigerator of claim 1, further comprising a condensate guide provided on the front surface of the first grill cover to guide the water or a condensate to the water tray.

8. The refrigerator of claim 7, wherein the condensate guide includes first guides that extend downward from opposite sides of the front surface of the first grill cover toward a central portion of the first grill cover.

9. The refrigerator of claim 8, wherein the first guides extend forward from the front surface of the first grill cover.

10. The refrigerator of claim 8, wherein the condensate guide further includes second guides that extend downward from opposite sides of the fan suction portion, and wherein the second guides are connected to the first guides and extend toward the central portion of the first grill cover.

11. The refrigerator of claim 1, wherein the grill cover further includes a second grill cover coupled to a rear portion of the first grill cover and having a fan seat on which the blower fan is seated.

12. The refrigerator of claim 11, wherein the second grill cover includes:

a second cover inserting portion provided below the fan seat and through which the water tray passes; and a discharge guide provided at an upper side of the second cover inserting portion and having a passage configured to guide downward discharge of a condensate.

13. The refrigerator of claim 12, wherein the discharge guide includes a first discharge guide and a second discharge guide that define the passage, and wherein the first discharge guide and the second discharge guide are downwardly inclined.

14. The refrigerator of claim 2, wherein a side portion of the second cover includes a cover discharge hole configured to introduce cold air, wherein the side portion of the second cover extends from an inner side of the cover discharge hole at an incline, and wherein the side portion of the second cover includes a side guide configured to guide discharge of the water.

15. The refrigerator of claim 1, further comprising:

a drain pipe that communicates with the water tray and configured to discharge the water collected in the water tray, wherein a rear portion of the water tray and a rear portion of the second cover are inserted into the drain pipe.

16. The refrigerator of claim 1, further comprising a door provided at the front side of the evaporator case, wherein the door is configured to open and close the first storage chamber and the second storage chamber.

* * * * *